US012075952B2

(12) United States Patent
Mochkin et al.

(10) Patent No.: US 12,075,952 B2
(45) **Date of Patent: *Sep. 3, 2024**

(54) TOILET

(71) Applicant: MZ CREATIONS INC

(72) Inventors: Chaim Mochkin, Bay Harbor, FL (US); Spencer Greenfeder, Fort Lauderdale, FL (US); Scott Faulkner, White Lakes (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/209,135

(22) Filed: Jun. 13, 2023

(65) Prior Publication Data

US 2023/0337872 A1 Oct. 26, 2023

Related U.S. Application Data

(63) Continuation of application No. 18/110,939, filed on Feb. 17, 2023, now Pat. No. 11,684,223.

(60) Provisional application No. 63/311,641, filed on Feb. 18, 2022.

(51) Int. Cl.
*A47K 11/02* (2006.01)

(52) U.S. Cl.
CPC ..... *A47K 11/026* (2013.01)

(58) Field of Classification Search
CPC ..... A47K 11/026; A47K 11/02
USPC ..... 4/460, 465, 470, 484
See application file for complete search history.

(56) References Cited

U.S. PATENT DOCUMENTS

| | | | | |
|---|---|---|---|---|
| 5,960,487 | A * | 10/1999 | Hawkins | A47K 11/02 4/484 |
| 9,364,124 | B2 * | 6/2016 | Morris | A47K 11/026 |
| 11,684,223 | B1 * | 6/2023 | Mochkin | A47K 11/026 4/484 |
| 2009/0255045 | A1 * | 10/2009 | Sakurai | A47K 11/026 4/484 |

* cited by examiner

*Primary Examiner* — Tuan N Nguyen
(74) *Attorney, Agent, or Firm* — David W. Barman; Shlomo S. Moshen

(57) ABSTRACT

The present invention is a toilet assembly having a central main bowl, waste bag, bag entrance guide, bag openers with clips, a roller assembly operatively associated with each of the waste bag and the bag openers, the roller assembly constructed and arranged to close and seal the waste bag.

20 Claims, 35 Drawing Sheets

SECTION I-I

TOILET

CROSS-REFERENCE TO RELATED APPLICATIONS

This application is continuation of U.S. patent application Ser. No. 18/110,939 filed Feb. 17, 2023 which is a non-provisional of and claims benefit to U.S. Provisional Patent Application Ser. No. 63/311,641 filed Feb. 18, 2022, the disclosures of which are incorporated hear in by reference in their entirety.

BACKGROUND OF THE INVENTION

In many parts of the world, water usage is extremely limited and often present difficulties. One very significant health concern is providing toilet facilities in such areas. Although there have been various attempts at providing toilet facilities using minimal or no water, each of these prior attempts present their own difficulties.

The present invention addresses this issue.

SUMMARY OF THE INVENTION

The present invention provides a toilet that is operated without water or power, in a hygienic, odorless, and user-friendly manner. This device will be used in a variety of different environments, ranging from boat and RV installations, car travel, off-the-grid homes, or in hospitals as a replacement for the bedside commode.

The present invention contemplates several embodiments configurable as needed for environment of use. These embodiments include a fixed version, portable version, child version, medical version, and a style version, as set forth below.

Fixed Version. Applications of the Fixed Version embodiments include, but are not limited to, off-grid homes, RVs/boats, etc. Key features of the Fixed Version embodiments include, but are not limited to, any one or more of the following: (1) similar in size to common household toilets; (2) industrial styling to fit in modern bathrooms; (3) fixed assembly, (4) not portable; (5) large waste storage capacity; and (6) large bag refill capacity.

Portable Version. Applications of the Portable Version embodiments include, but are not limited to, car travel, camping, construction sites, emergency response, and military applications. Key features of the Portable Version embodiments include, but are not limited to, any one or more of the following: (1) portable and compact for easy packing and carrying; and (2) smaller waste storage capacity.

In one embodiment, the Portable Version includes a single use waste compartment, such as a disposable waste bag (i.e., use once and dispose waste bag immediately). In one embodiment, the Portable Version includes fold out legs or other means of standing on ground at normal toilet height, similar to camping chairs.

In another embodiment, the Portable Version unit has attachments for mounting to seat in car, possibly using anchor points in seats similar to how children's car-seats are mounted/secured.

A further embodiment of the Portable Version unit is configured to be mounted into an interlocking style toolbox for construction workers.

Another embodiment of the Portable Version is configured to be mounted in 'cooler' style wheely box.

Child Version. Applications of the Child Version include, but are not limited to, quick deployment during travel emergencies, and potty training. Key features of the Child Version include, but are not limited to, any one or more of the following: (1) smaller scale frame/shell; and (2) portable for travel use. In one embodiment, the Child Version unit is configured to attach to car-seat anchor points. In one embodiment, the Child Version unit is configured to utilize smaller, child sized bags.

Medical Commode/Version. Applications of the Medical Version unit include, but are not limited to hospitals/care-homes/etc. (in place of a commode), collection of stool and urine samples, and drug testing. Key features of the Medical Version unit include, but are not limited to, any one or more of the following: (1) the unit is configured to attach to either a generic commode frame or a custom frame made specifically for this application; (2) the unit is portable and/or on roller wheels; (3) the unit is configured for single use waste disposal (as described above); (4) the unit is adapted for attachment/mounting to wall, the wall having an aperture or conduit for transferring the deposited medical samples directly to medical staff on the other side of the aperture/conduit.

Style Version. Applications of the Style Version unit includes, but are not limited to, construction sites, festivals, sports events, and outdoor gatherings. Key features of the Style Version unit include, but are not limited to, any one or more of the following: (1) the unit is adapted to be integrated into port-a-loo sized toilet cubicles, such as brought in by truck; (2) the unit has large waste storage capacity and bag capacity; and (3) the bags can be fed from large central spools.

There is provided, in accordance with one embodiment of the present invention, a toilet assembly comprising a toilet seat assembly, a main chassis, a front bag guide, a drive assembly, and an opener arm assembly. The toilet seat assembly comprising a toilet seat and a toilet lid. The drive assembly comprising a flush drive mechanism and at least two drive rollers. The opener arm assembly comprising first and second opener arms configured to pivot between closed and open positions. A bag assembly is installed and utilized in connection with the toilet seat assembly. The bag assembly comprises at least one waste bag. The waste bag has first and second panels joined to one another along a common bottom edge and along a first side edge and a second side edge so that the waste bag has an interior. The first and second panels have respective top and bottom portions extending between the first side edge and the second side edge. Each of the top portions comprise an upper guide bead portion and a lower sealing portion. The upper guide portion forms a top edge defining a mouth opening into the interior. The lower sealing portion comprises an interior-facing sealing mechanism and one or more at least partially exterior-facing guide ribs. The interior-facing mechanism of the first panel is oriented to engage the interior-facing mechanism of the second panel to permanently or releasably seal the mouth. The drive assembly releasably engages the exterior-facing guide ribs to secure and suspend a first end of the waste bag proximate to the first side edge. The front bag guide releasably engages the exterior-facing guide ribs to secure and suspend a second end of the waste bag proximate to the second side edge. The first opener arm is configured to releasably engage the first panel and the second opener arm is configured to releasably engage the second panel. When the first and second opener arms pivot to the open position, the first and second panels pivot laterally to the open position, and when the first and second opener arms retract to the closed position, the first and second panels pivot medially to the closed position, which closes the waste bag prior to disposal. When the flush drive mechanism is engaged, the closed waste bag is driven through the drive rollers along said exterior-facing guide ribs, causing the interior-facing mechanism to seal the waste bag and thereafter deposit the now-sealed waste bag into a waste compartment.

In one embodiment, the toilet seat assembly further comprises a pair of actuating members coupled to the toilet lid. The actuating members are operatively associated with the first and second opener arms. When the toilet lid is opened, the actuating members engage the first and second opener arms, whereby the first and second opener arms pivot to the open position. When the toilet lid is closed, the actuating members disengage the first and second opener arms, whereby the first and second opener arms retract to the closed position. The actuating members comprise at least one of a lever-follower mechanism, a pulley mechanism, a gears and belts mechanism, an electronic motor mechanism, or a spring-loaded mechanism, or a combination thereof.

In one embodiment, the toilet seat assembly further comprises at least one actuating member causing the first and second opener arms to pivot to the open position and to retract to the closed position. The actuating member comprises at least one of a pair of horizontally pivoting arms, one or more pairs of clips on linear rails, a spring-loaded mechanism on the underside of said toilet seat, a vacuum mechanism arranged beneath said waste bag, a full-rail mechanism using positive engagement with said waste bag, or magnetic material integrated into said waste bag and one or more magnets operatively associated with said magnetic material and arranged beneath said toilet seat, or a combination thereof.

In one embodiment, the flush drive mechanism comprises at least one of a crank handle, a lever mechanism, a foot pedal, or an electronic motor with a push button, or a combination thereof.

In one embodiment, the drive assembly further comprises at least two roller shafts and at least two drive lobes, each operatively associated with a respective one of the drive rollers. In this embodiment, the flush drive mechanism is integrated with said roller shafts.

In one embodiment, the drive assembly further comprises at least two roller shafts and at least two drive lobes, each operatively associated with a respective one of the drive rollers. In this embodiment, the flush drive mechanism is mechanically linked to the roller shafts by at least one of a meshed gear, a belt, or a chain, or a combination thereof.

In one embodiment, the drive assembly further comprises a bag compressor mechanism. The bag compressor mechanism comprises at least one of soft foam cylinders, compliant flap rollers, inflated cushion rollers, or soft bristled rollers, or a combination thereof.

In one embodiment, the toilet assembly further comprises a splash rim extending vertically down into the main chassis within the mouth of the waste bag. The splash rim is actuated downwards by at least one of a spring-loaded mechanism, a linkage, or a cam, or a combination thereof.

In one embodiment, the opener arm assembly further comprises at least one bag clip and clip holder coupled to the first opener arm and configured to secure the upper guide bead portion of the first panel to the first opener arm, and at least one bag clip and clip holder coupled to the second opener arm and configured to secure the upper guide bead portion of the second panel to the second opener arm.

In one embodiment, the opener arm assembly further comprises at least one of magnets, adhesive or semi-adhesive material, or a mechanism having guided holes on a track, or a combination thereof, to secure the upper guide bead portions of the first and second panels to the first and second opener arms.

In one embodiment, the drive assembly further comprises a pin latch mechanism configured to engage an indexing hole of the waste bag.

In one embodiment, the main chassis assembly further comprises a bag refill compartment for storing a bag refill cartridge and a refill access door for accessing the bag refill compartment.

In one embodiment, the interior-facing mechanism comprises at least one of a zipper closure, an interlocking hook mechanism, a bead-in-channel setting, a reversed hooks with malleable seal in center, a contact adhesive, hook-and-loop strips, a magnetic seal, or a heat-sealing mechanism, or a combination thereof.

In one embodiment, the toilet assembly further comprises a bag joiner interlocking mechanism for coupling the second end of a last waste bag in a first bag refill cartridge to the first end of a first waste bag in a second bag refill cartridge.

In one embodiment, the bag assembly is disposed within the main chassis assembly.

In one embodiment, the waste compartment is an external waste compartment. A chute is provided, which directs the waste bag into the external waste compartment.

There is provided, in accordance with one embodiment of the present invention, a toilet assembly comprising a toilet seat assembly, a main chassis, a front bag guide, a drive assembly, and an opener arm assembly. The toilet seat assembly comprising a toilet seat and a toilet lid. The drive assembly comprising a flush drive mechanism and at least two drive rollers. The opener arm assembly comprising first and second opener arms configured to pivot between closed and open positions. A bag assembly is installed and utilized in connection with the toilet seat assembly. The bag assembly comprises at least one waste bag. The waste bag has a first outer side edge, an inner side edge, and a second outer side edge. The waste bag has a first section formed between the first outer side edge and the inner side edge. The waste bag has a second section formed between the inner side edge and the second outer side edge. The first and second sections are joined to one another along the inner side edge. The first section comprises a sealed section, a first upper guide bead portion, and one or more at least partially exterior-facing first guide ribs. The second section has first and second panels joined to one another along a common bottom edge and along the second outer side edge and the inner side edge so that the waste bag has an interior. The first and second panels have respective top and bottom portions extending between the second outer side edge and the second inner side edge. Each of the top portions comprise a second upper guide bead portion and a lower sealing portion. The upper guide portion forms a top edge defining a mouth opening into the interior. The lower sealing portion comprises an interior-facing sealing mechanism and one or more at least partially exterior-facing second guide ribs. The interior-facing mechanism of the first panel is oriented to engage the interior-facing mechanism of the second panel to permanently or releasably seal the mouth. The drive assembly releasably engages the exterior-facing first guide ribs of the first vertical section to secure and suspend a first end of the waste bag proximate to the first outer side edge. The front bag guide releasably engages the exterior-facing second guide ribs of the second vertical section to secure and suspend a second end of the waste bag proximate to the second outer side edge. The first opener arm is configured to releasably engage the first panel and the second opener arm is configured to releasably engage the second panel. When the first and second opener arms pivot to the open position, the first and second panels pivot laterally to the open position, and when the first and second opener arms retract to the closed position, the first and second panels pivot medially to the closed position, which closes the waste bag prior to disposal. When the flush drive mechanism is engaged, the closed waste bag is driven through the drive rollers along the exterior-facing first and second guide ribs, causing the interior-facing mechanism to seal the second vertical section of the waste bag and thereafter deposit the now-sealed waste bag into a waste compartment.

In one embodiment, the drive assembly further comprises a pin latch mechanism configured to engage an indexing hole of the first section of the waste bag.

In one embodiment, the waste compartment is an external waste compartment. A chute is provided, which directs the waste bag into the external waste compartment.

DETAILED DESCRIPTION OF THE INVENTION

Figure 1:
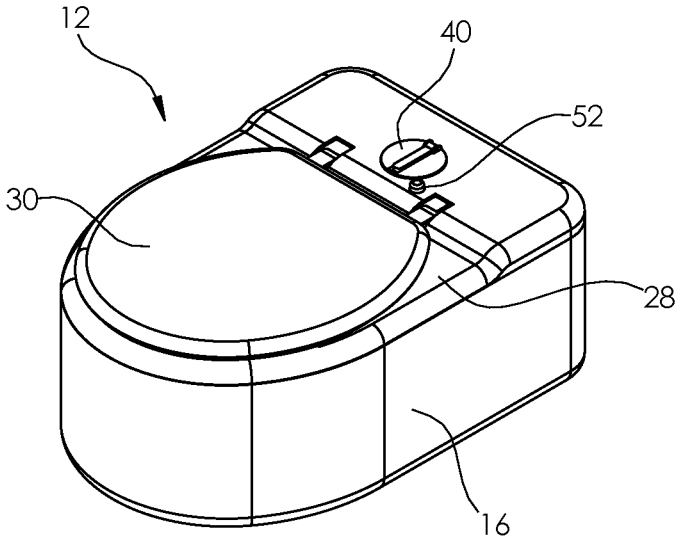
FIG. 1 is a perspective view of the toilet assembly according to one embodiment of the present invention.
Figure 2:
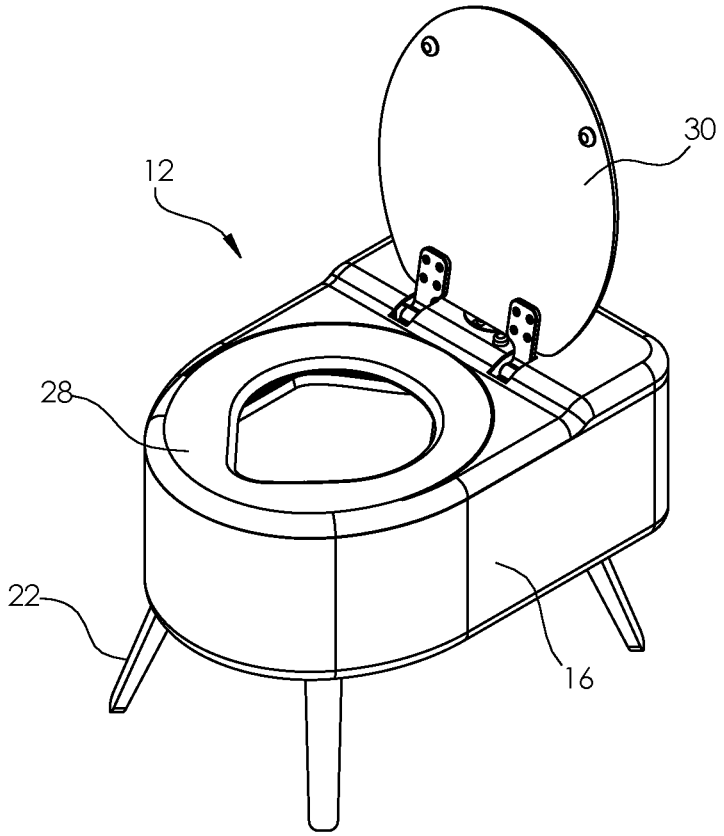
FIG. 2 is a perspective view of the toilet assembly open according to one embodiment of the present invention.

As generally understood by the figures, the "Pack-A-Loo" portable toilet assembly of the present invention, as detailed in FIG. 1 and FIG. 2, utilizes a continuous zipper bag to individually portion waste for disposal. After each use, a 'flush' cycle is initiated to pull a fresh section of the zipper bag into the internal bowl region, which is then opened ready for use. During this flush cycle the used bag is simultaneously sealed off and transported to a waste compartment for disposal. This flush cycle will be actuated by the user via a mechanical means.

FIG. 1 and FIG. 2 illustrate, according to one embodiment, a portable toilet assembly 12 having a main chassis/bowl 16 (also referred to as the "internal bowl region"), a toilet seat 28 and a toilet lid 30. FIG. 1 additionally features a crank handle 40 and a release button 52. FIG. 2 additionally features fold-out legs 22.

Figure 3:
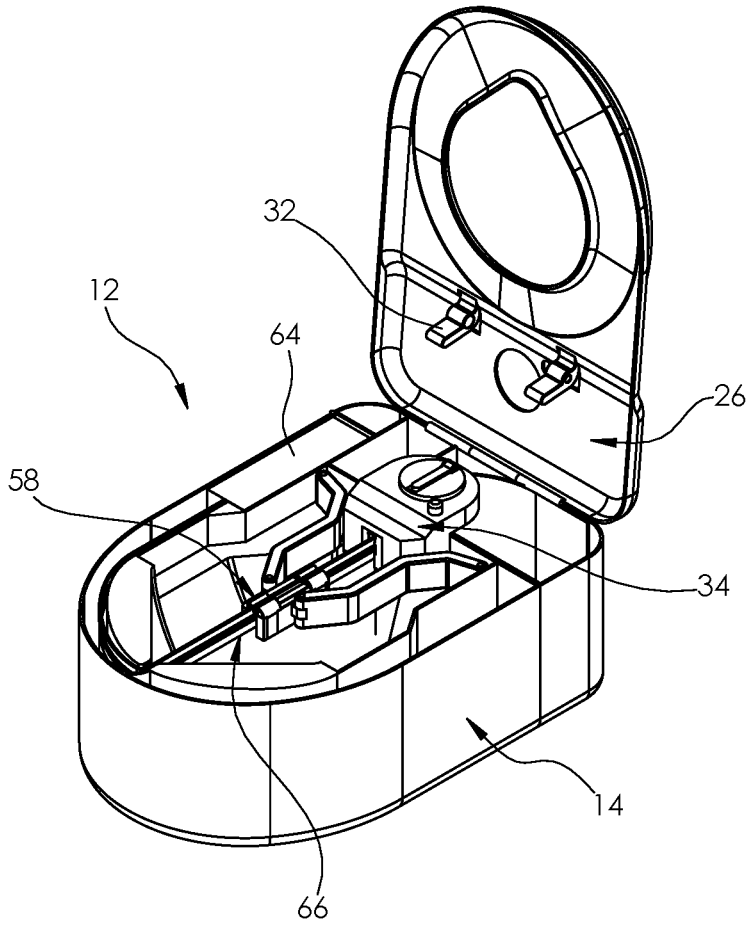
FIG. 3 is an exploded view of sub-assemblies according to one embodiment of the present invention.

FIG. 3 illustrates, according to one embodiment, portable toilet assembly 12 having a main chassis/bowl assembly 14, a toilet seat assembly 26 (also referred to as "lid assembly") having toilet lid hinges 32, a drive assembly 34, an opener arm assembly 58, a zipper bag refill cartridge 64 and a zipper bag assembly 66.

Figure 4:
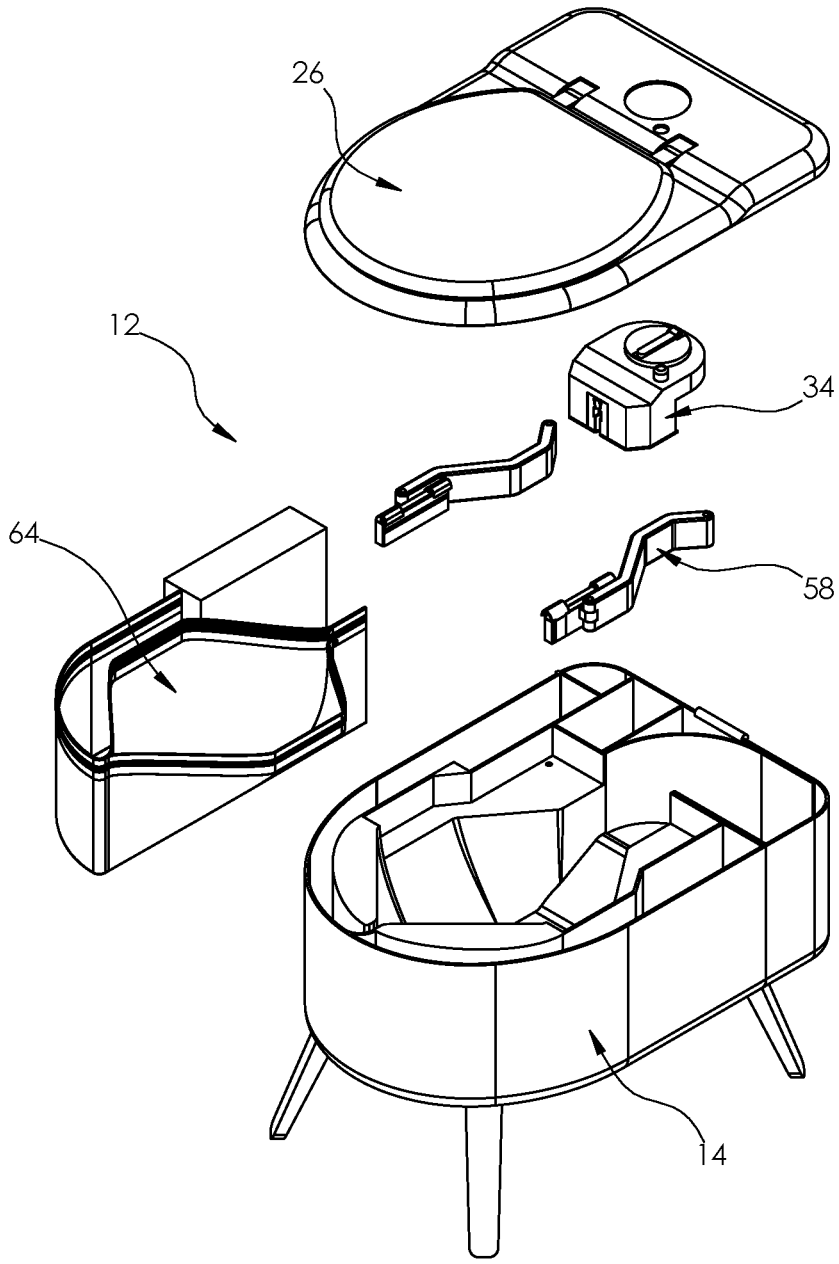
FIG. 4 is an exploded view of separated components of a main chassis and bowl assembly according to one embodiment of the present invention.

FIG. 4 illustrates, according to one embodiment, an exploded view of sub-assemblies of portable toilet assembly 12, including main chassis/bowl assembly 14, toilet seat assembly 26, drive assembly 34, an opener arm assembly 58, and zipper bag refill cartridge 64.

Figure 5:
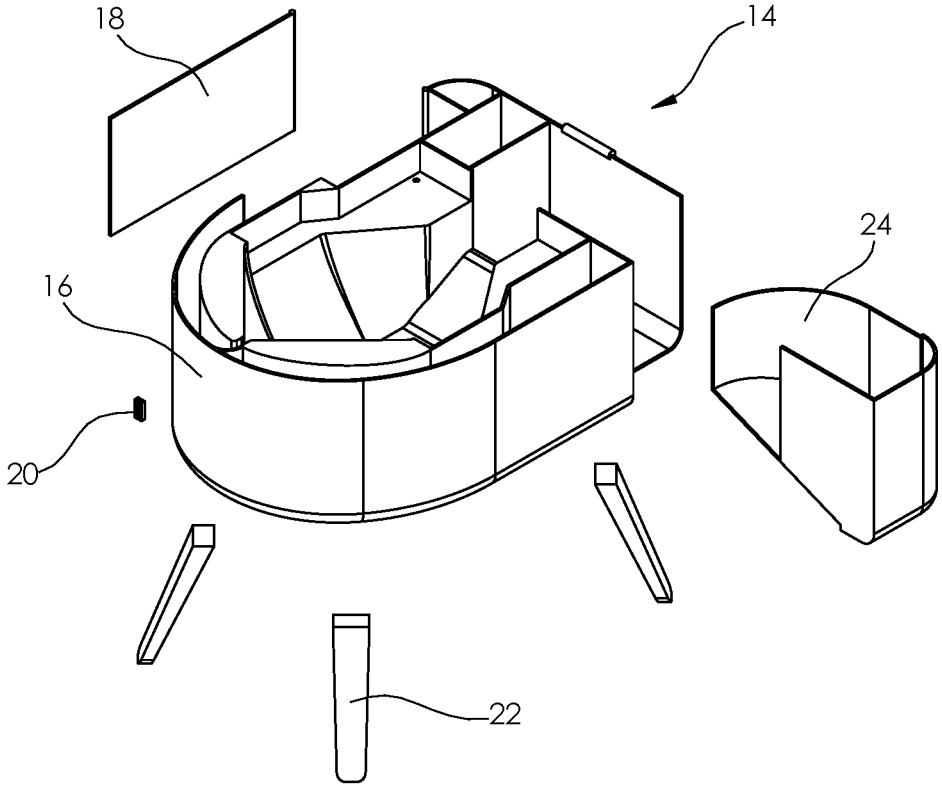
FIG. 5 is a perspective view of separated components of the bowl according to one embodiment of the present invention.

FIG. 5 illustrates, according to one embodiment, an exploded view of main chassis/bowl assembly 14, including main chassis/bowl 16, a refill access door 18, a front bag guide 20, fold-out legs 22, and a waste compartment 24.

Figure 6:
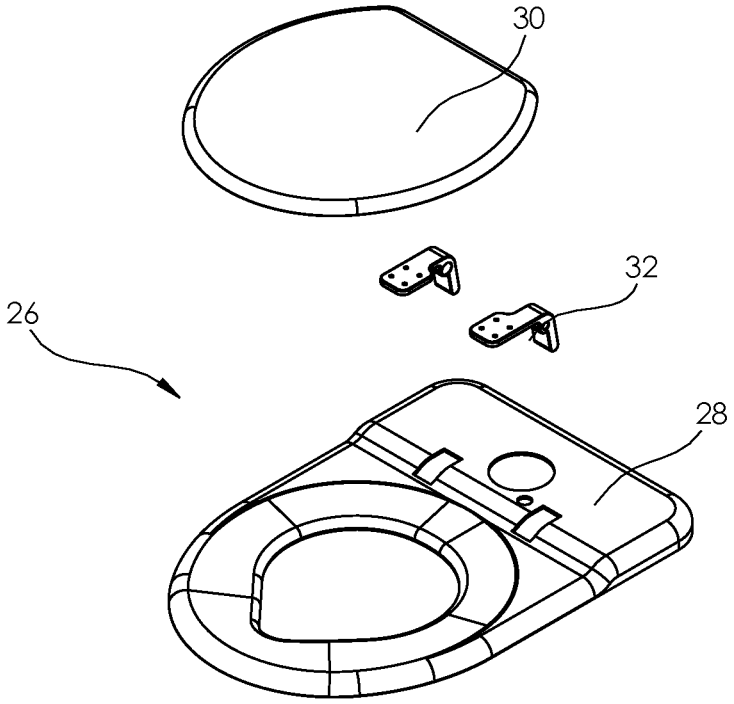
FIG. 6 is a perspective view of separated components of the toilet seat assembly according to one embodiment of the present invention.

FIG. 6 illustrates, according to one embodiment, an exploded view of toilet seat assembly 26, including toilet seat 28, toilet lid 30 and toilet lid hinges 32.

Figure 7:
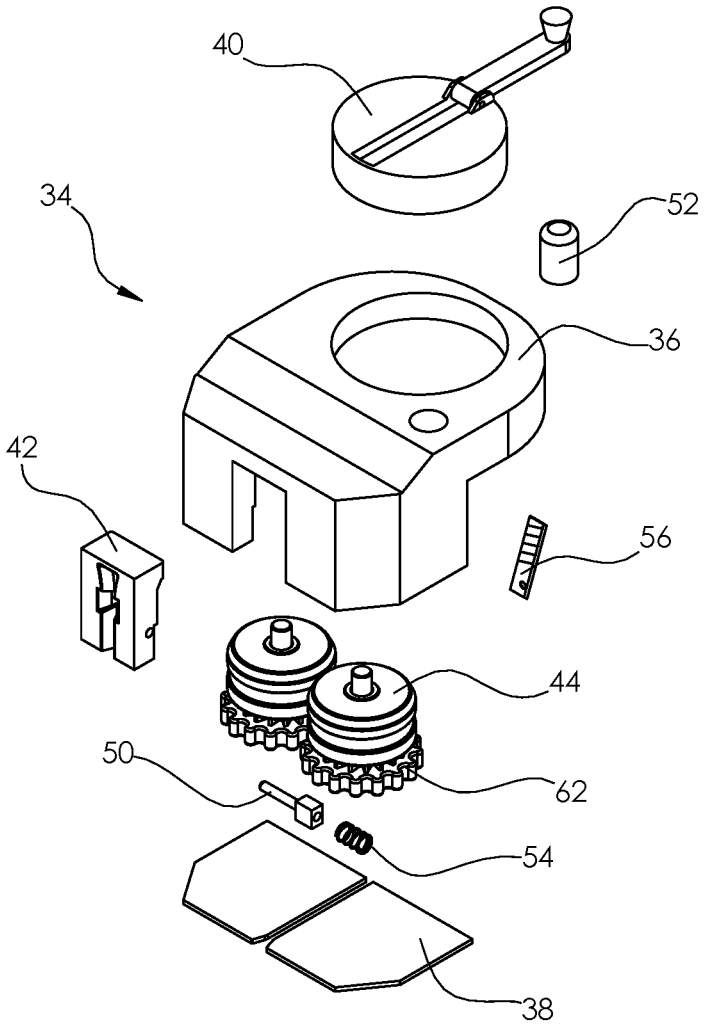
FIG. 7 is a perspective view of separated components of the drive mechanism according to one embodiment of the present invention.

FIG. 7 illustrates, according to one embodiment, an exploded view of drive assembly 34 having an upper drive housing 36, a lower drive housing 38, crank handle 40, a bag closer guide 42, drive rollers 44, drive lobes 45, an indexing pin 50, a release button 52, an indexing spring 54, and a bag cutter/separator 56.

Figure 8:
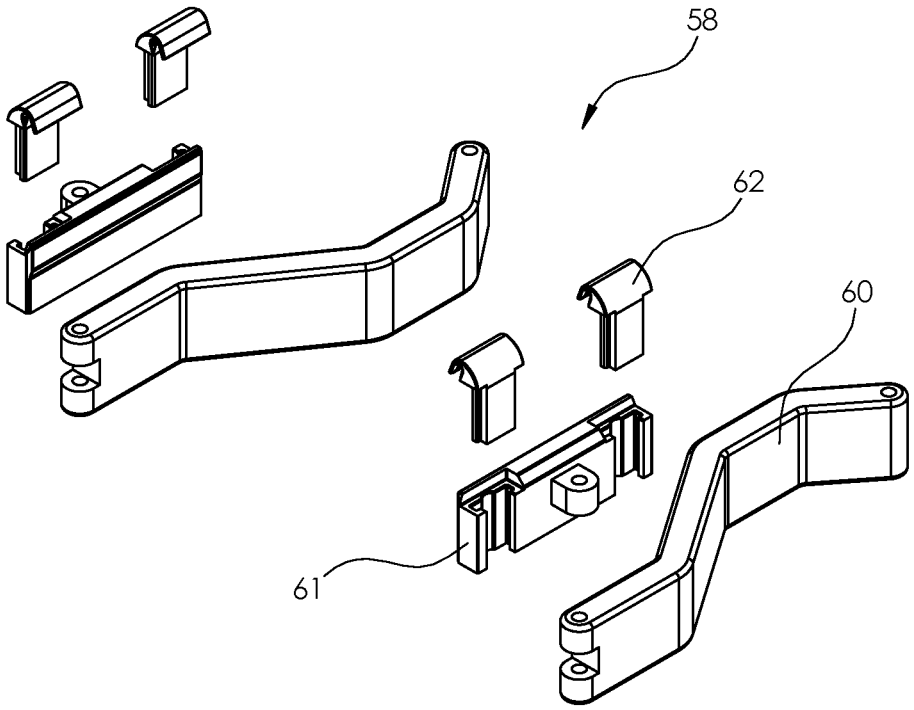
FIG. 8 is a perspective view of separated components of the open arm assembly according to one embodiment of the present invention.

FIG. 8 illustrates, according to one embodiment, an exploded view of opener arm assembly 58 having a pair of opener arms 60, a pair of clip holders 61, and four bag clips 62.

Figure 9:
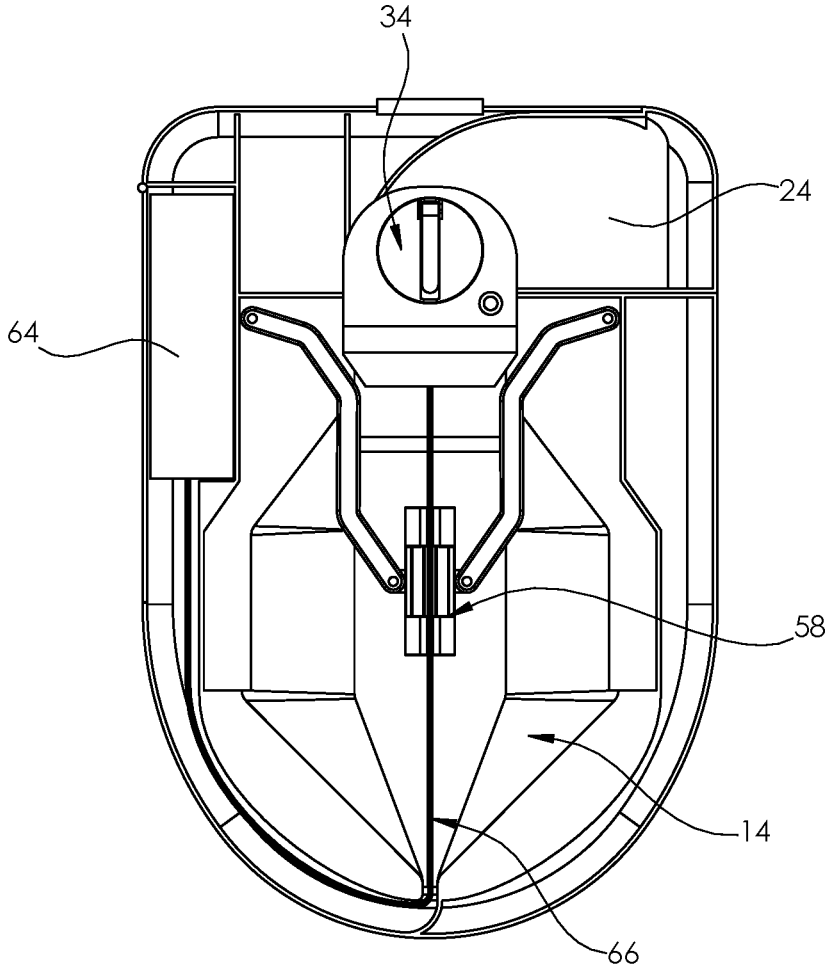
FIG. 9 is a top plan view of the main chassis/bowl with the seat removed and bag closed according to one embodiment of the present invention.
Figure 10:
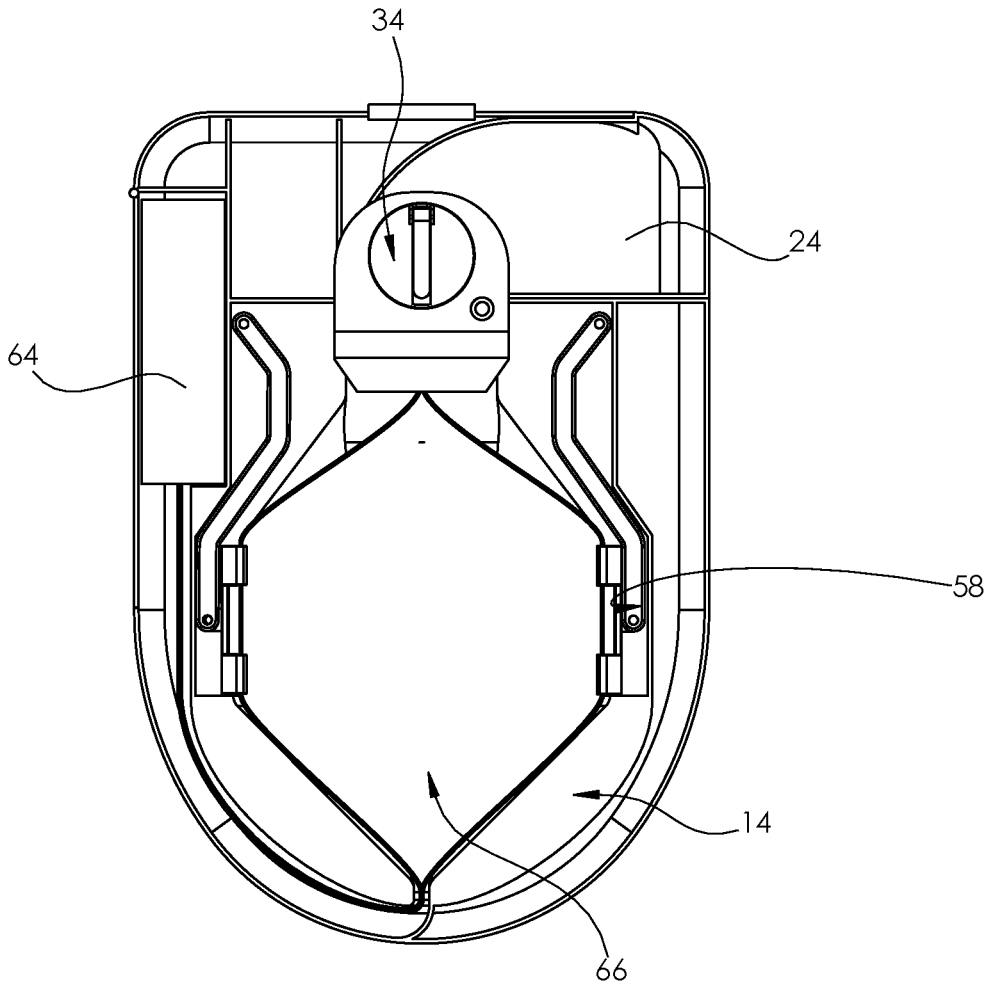
FIG. 10 is a top plan view of the main chassis/bowl with the seat removed and bag open according to one embodiment of the present invention.

FIG. 9 and FIG. 10 illustrate, according to one embodiment, a plan view of main chassis/bowl assembly 14 with the seat hidden, including waste compartment 24, drive assembly 34 (including, but not numbered, upper drive housing 36, crank handle 40 and release button 52), opener arm assembly 58, zipper bag refill cartridge 64, and zipper bag assembly 66. In FIG. 9 the bag is closed. In FIG. 10 the bag is open.

Figure 11:
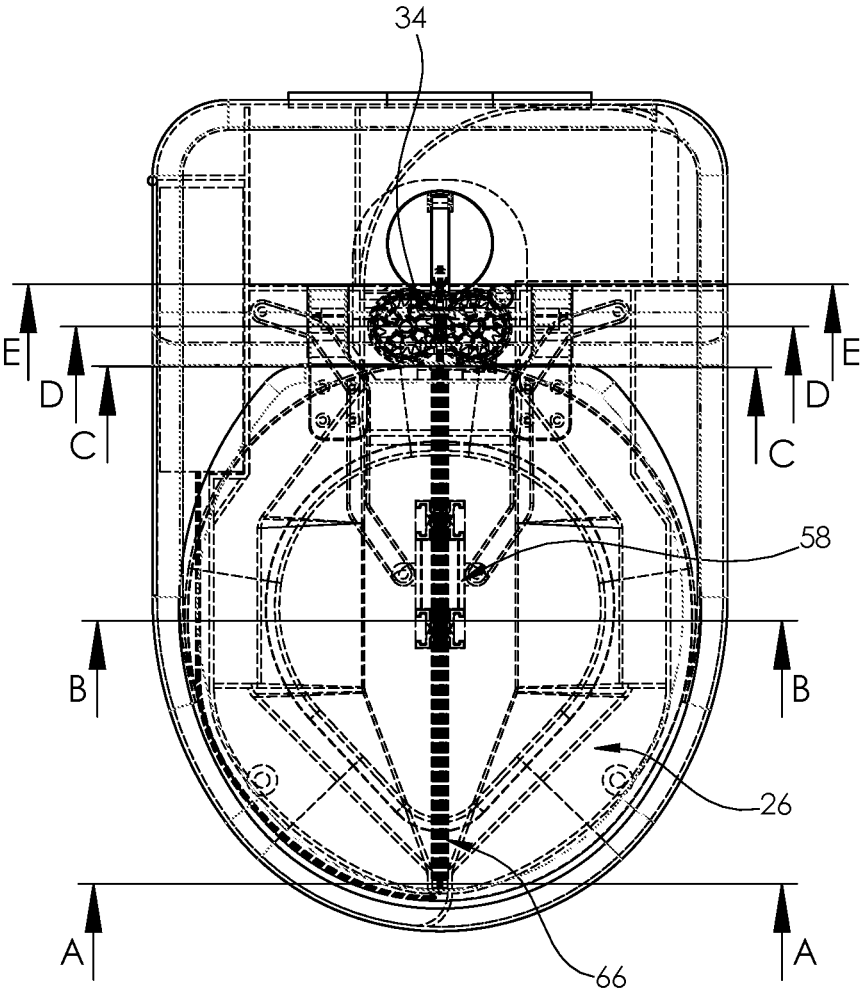
FIG. 11 is a top plan view of the toilet seat assembly with the lid closed and bag installed according to one embodiment of the present invention.

FIG. 11 illustrates, according to one embodiment, toilet seat assembly 26 with toilet lid (30) closed and a bag of zipper bag assembly 66 installed closed opener arms (60) of opener arm assembly 58 and drive assembly 34.

Figure 12:
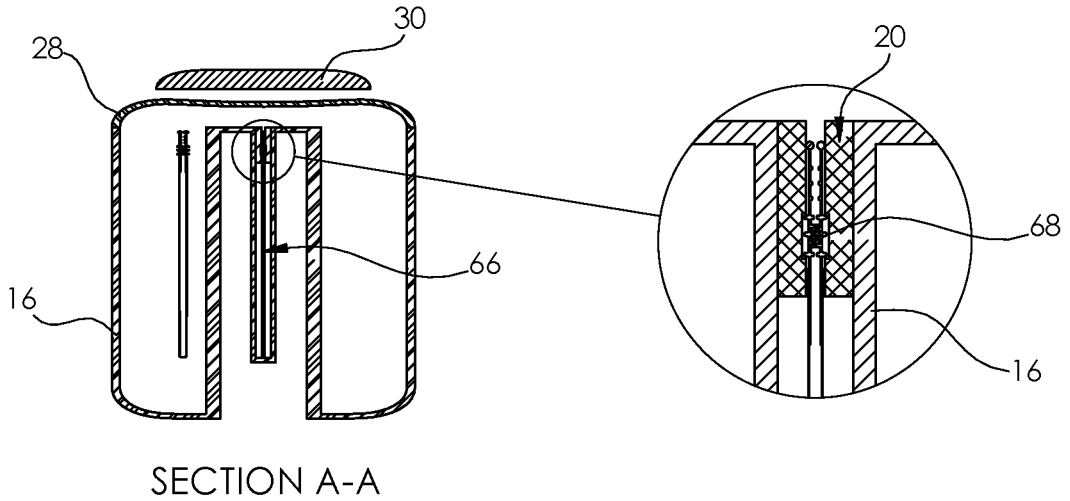
FIG. 12 is cross section along section lines A-A from FIG. 11 of the bag installed including a close-up view according to one embodiment of the present invention.
Figure 13:
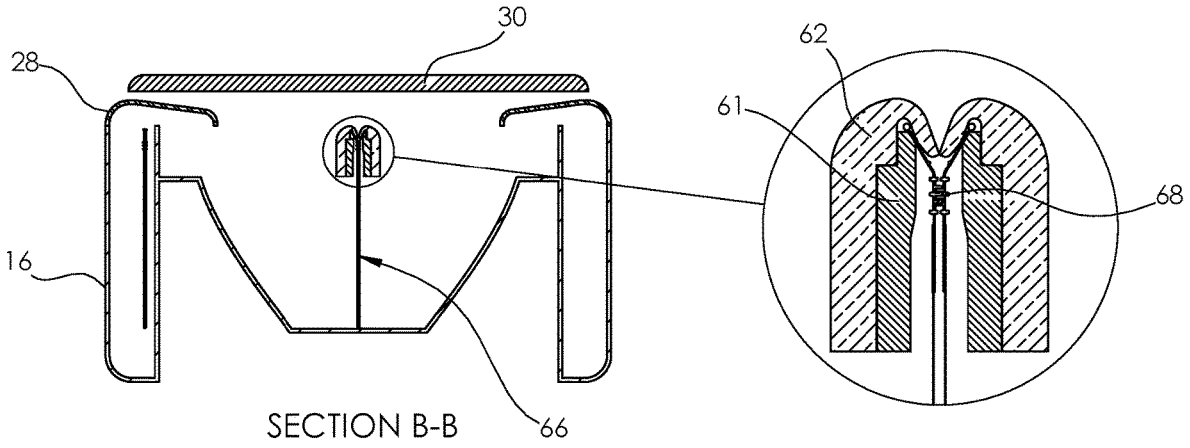
FIG. 13 is cross section along section lines B-B from FIG. 11 of the bag installed into closed opener arms including a close-up view according to one embodiment of the present invention.
Figure 14:
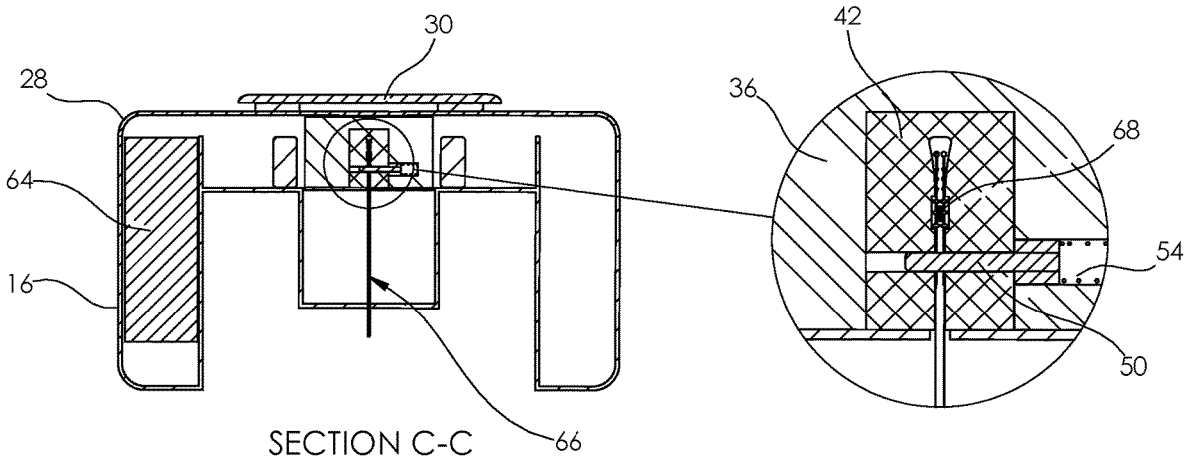
FIG. 14 is cross section along section lines C-C from FIG. 11 of the bag installed into closer guide with indexing pin including a close-up view according to one embodiment of the present invention.
Figure 15:
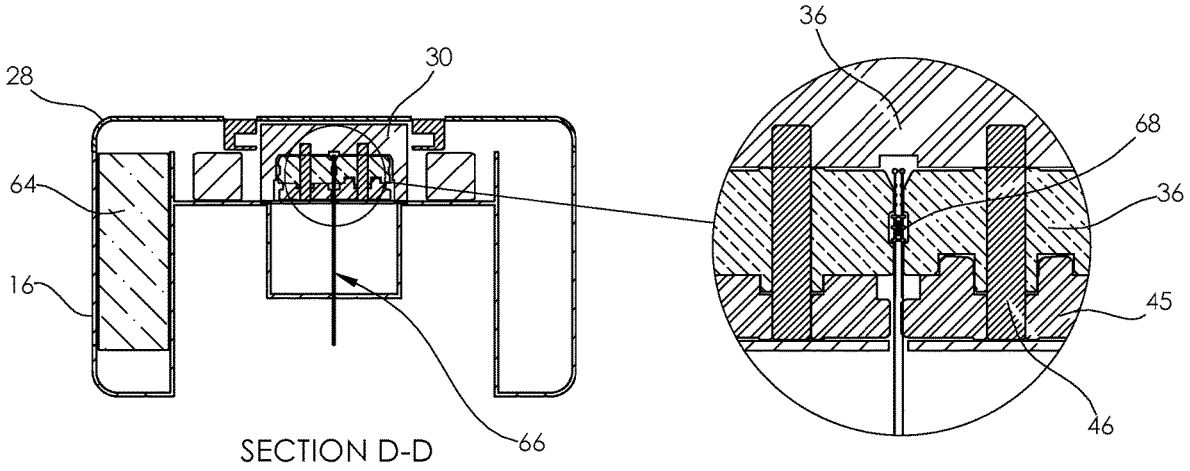
FIG. 15 is cross section along section lines D-D from FIG. 11 of the bag installed into rollers including a close-up view according to one embodiment of the present invention.
Figure 16:
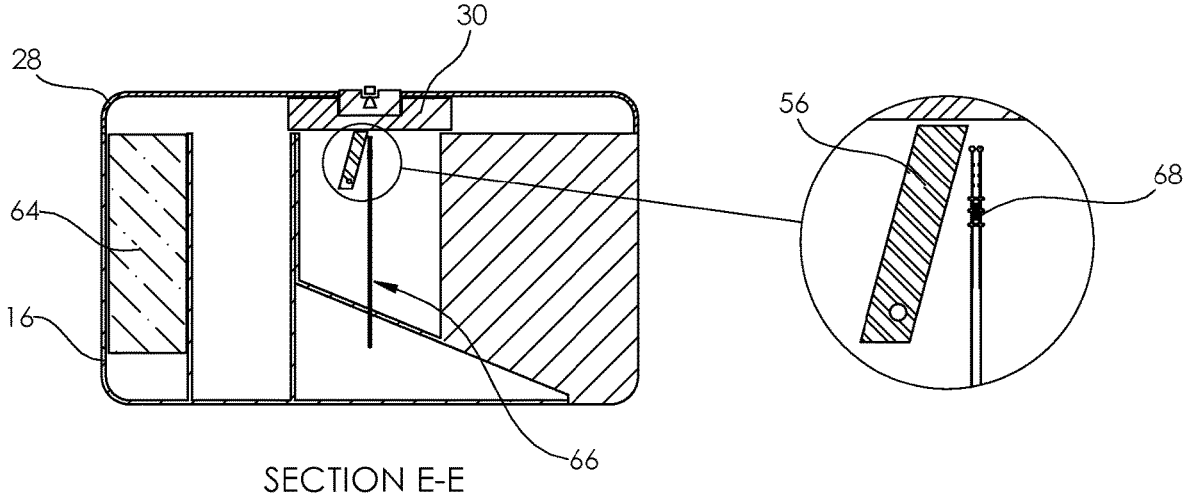
FIG. 16 is cross section along section lines E-E from FIG. 11 of the bag cutter including a close-up view according to one embodiment of the present invention.

FIG. 12 through FIG. 16 illustrate cross sections along section lines A-A through lined E-E from FIG. 11, respectively, according to one or more embodiments of the invention, including such common/shared features as main chassis/bowl 16, toilet seat 28 with toilet lid 30, and zipper bag assembly 66. In FIG. 12 through FIG. 15, the bag is shown installed. FIG. 12 further illustrates, along section lines A-A, the bag (including zipper extrusion 68) installed in a front guide 20 of main chassis/bowl assembly (14) along an inner perimeter of main chassis/bowl 16, as shown in a close-up view. FIG. 13 further illustrates, along section lines B-B, the bag installed into opener arm assembly (58) of which clip holder 61, bag clip 62, and zipper extrusion 68 are shown in a close-up view. (Not shown in the embodiment illustrated in FIG. 13 is opener arms 60, which are closed.) FIG. 14 further illustrates, along section lines C-C, the bag installed in a bag closer guide 42 of drive assembly (34) with indexing pin 50 of indexing mechanism (48), in which the close-up view includes an upper drive housing 36, bag closing guide 42, indexing pin 50, indexing spring 54, and zipper extrusion 68. FIG. 15 further illustrates, along section lines D-D, the bag installed in rollers of drive assembly (34), in which the close-up view includes upper drive housing 36, drive rollers 44, drive lobes 45, roller shafts 46, and zipper extrusion 68. FIG. 16 further illustrates, along section lines E-E, a bag cutter, in which the close-up view includes bag cutter/separator 56 and zipper extrusion 68.

Figure 17:
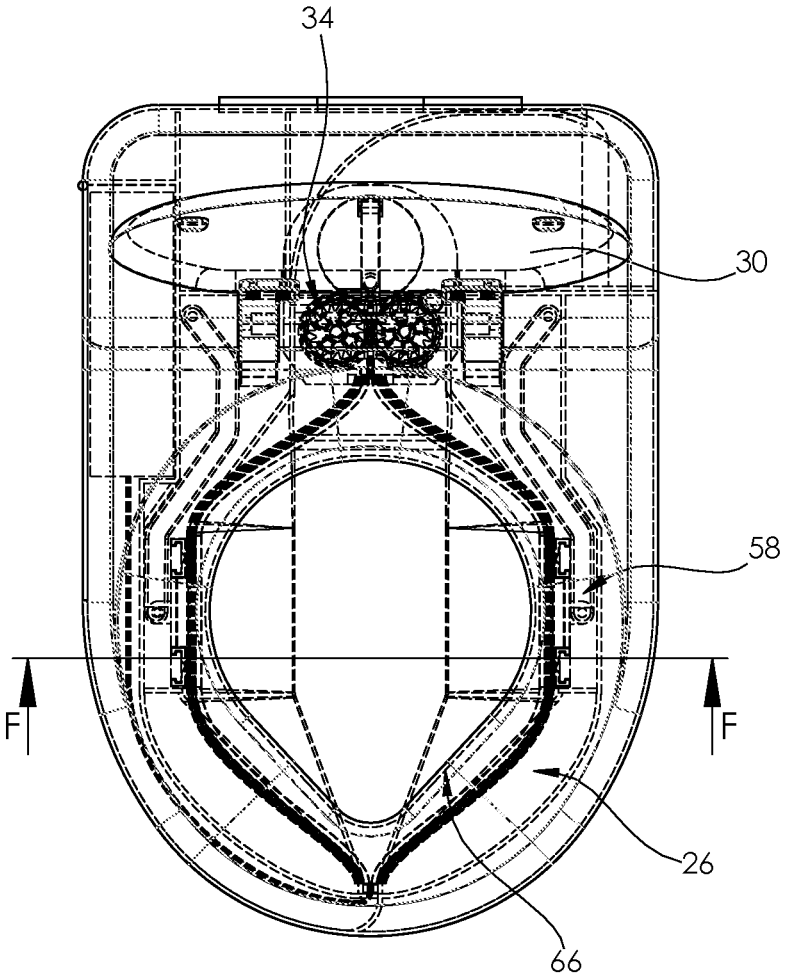
FIG. 17 is top plan view with the lid open and the bag open according to one embodiment of the present invention.

FIG. 17 illustrates, according to one embodiment, toilet seat assembly 26 with toilet lid 30 open, drive assembly 34, opener arm assembly 58 in which opener arms (60) are in an open position, thus having opened an installed bag of zipper bag assembly 66.

Figure 18:
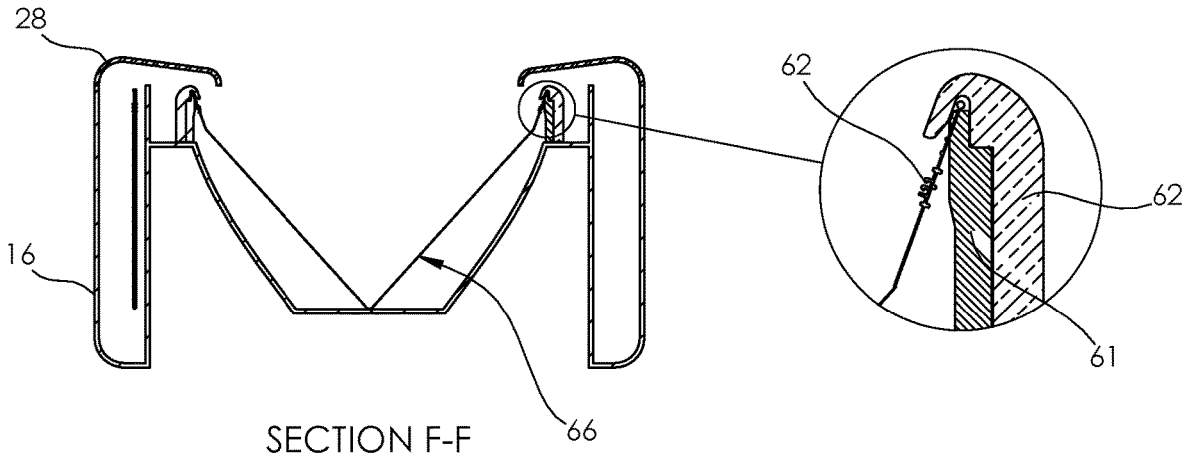
FIG. 18 is cross section along section lines F-F from FIG. 17 with the lid open and the bag open according to one embodiment of the present invention.

FIG. 18 illustrates, according to one embodiment, a cross section along section lines F-F from FIG. 17, including main chassis/bowl 16, an open toilet lid (30) of toilet seat 28, an open bag of zipper bag assembly 66, and a close-up view showing clip holder 61, bag clip 62, and zipper extrusion 68.

Figure 19:
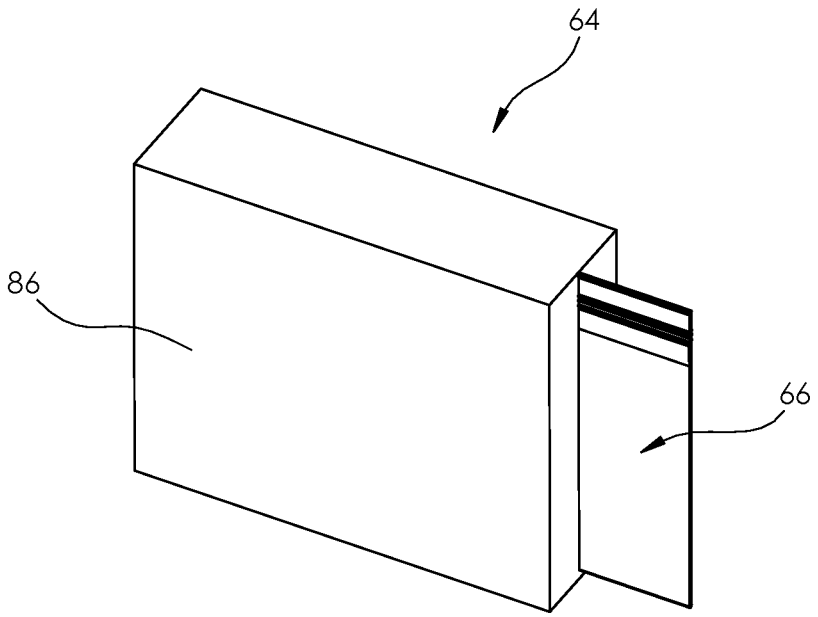
FIG. 19 is a perspective view of a bag refill cartridge according to one embodiment of the present invention.

FIG. 19 illustrates, according to one embodiment, a new zipper bag refill cartridge 64, including an outer packaging cartridge 86 for storing zipper bag assembly 66.

Figure 20:
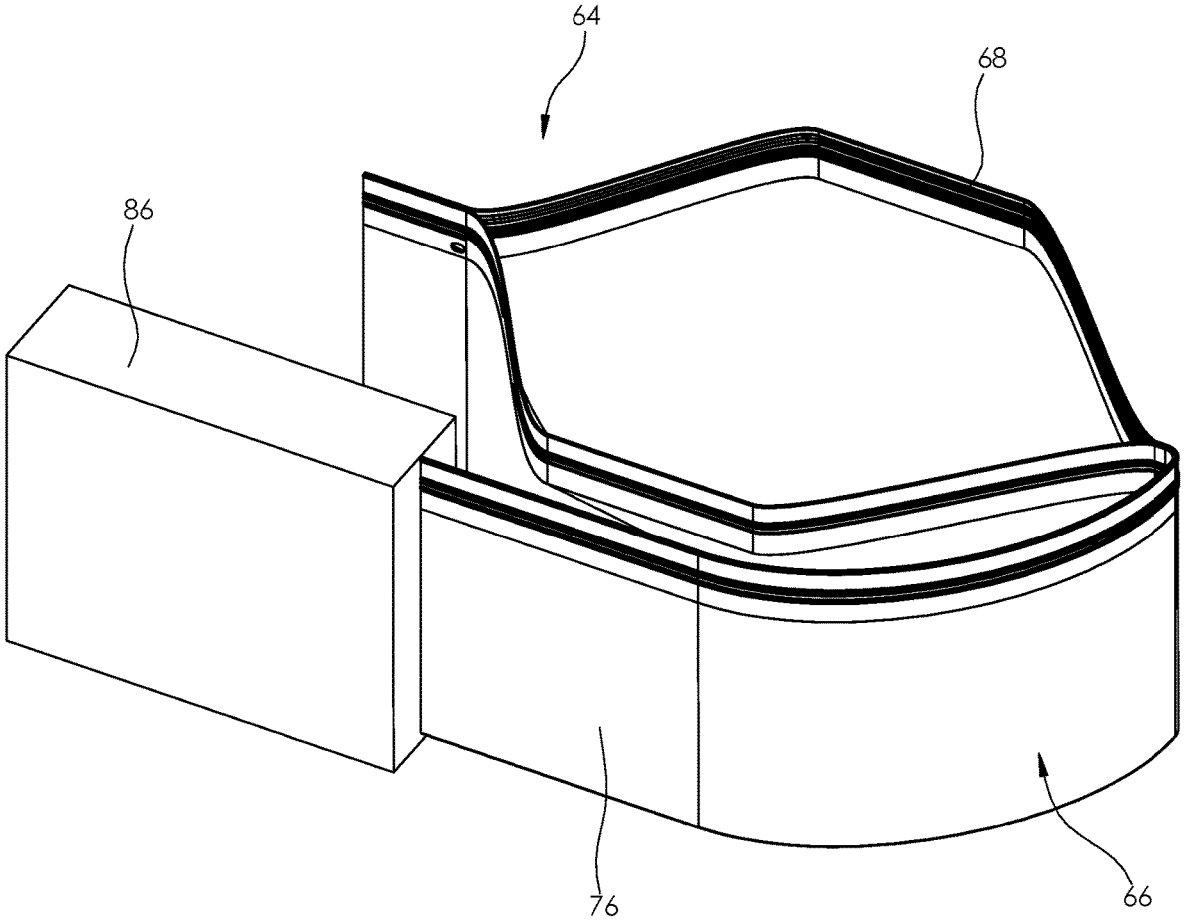
FIG. 20 is a perspective view of a bag refill cartridge with bags extending outward therefrom according to one embodiment of the present invention.

FIG. 20 illustrates, according to one embodiment, zipper bag refill cartridge 64, including outer packaging cartridge 86 and zipper bag assembly 66 shown as a continuous horizontal series of bags extending outward from packaging cartridge 86. Each bag comprises a main bag film 76 and an upper zipper extrusion 68.

Figure 21:
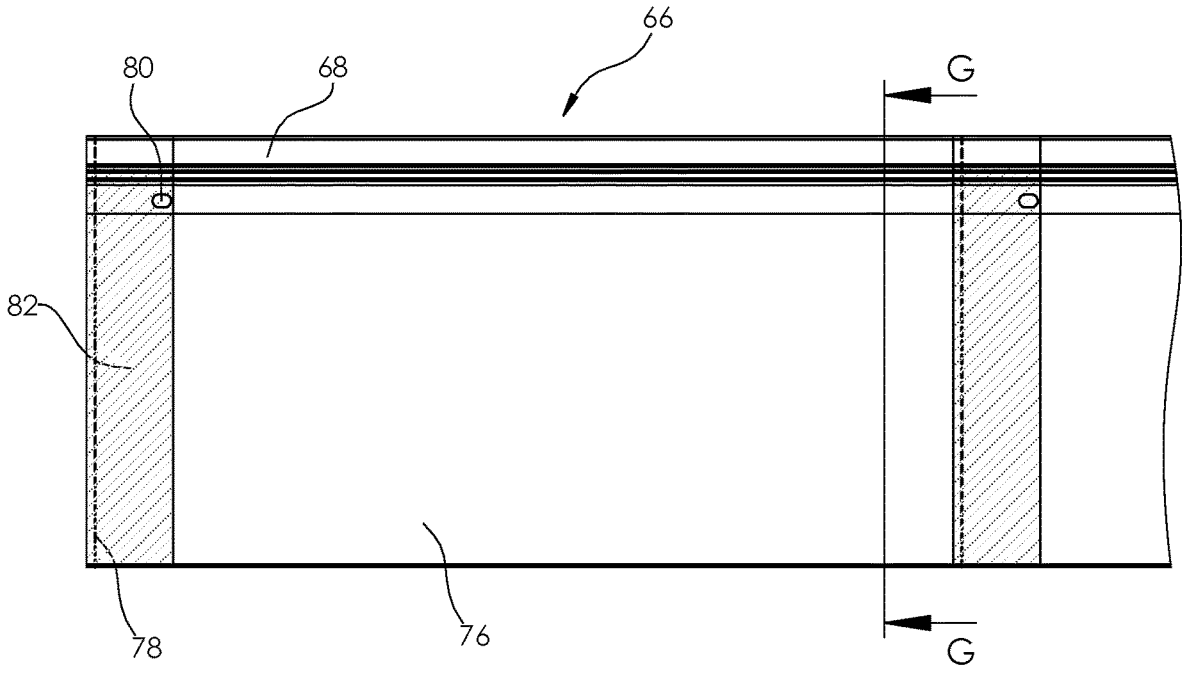
FIG. 21 is a side view of a zipper bag assembly according to one embodiment of the present invention.

FIG. 21 illustrates, according to one embodiment, a side view zipper bag assembly 66, including zipper extrusion 68, bag film 76, a bag perforation 78, an indexing hole 80, and a vertical sealed section 82.

Figure 22:
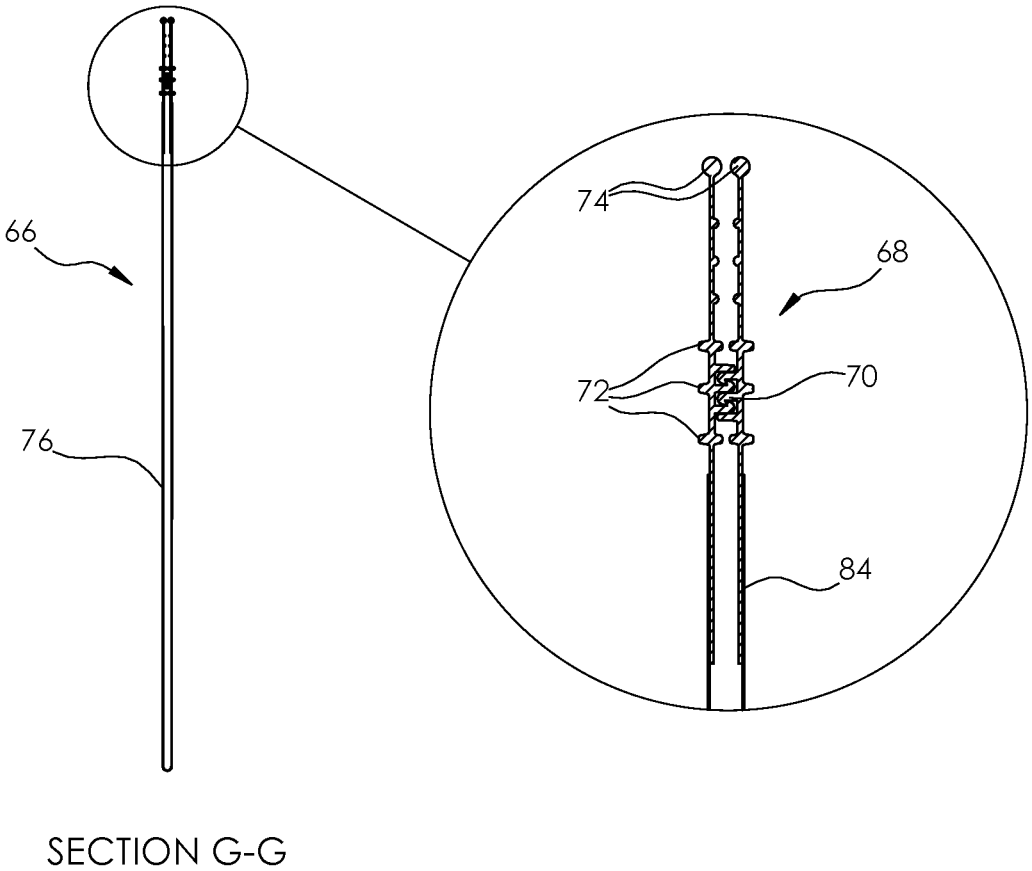
FIG. 22 is cross section along section lines G-G from FIG. 21 of a zipper bag assembly including a close-up view according to one embodiment of the present invention.

FIG. 22 illustrates, according to one embodiment, a cross section along section lines G-G from FIG. 21, including zipper bag assembly 66 and bag film 76, and a close-up view showing zipper extrusion 68, a zipper closure 70, zipper guide ribs 72, opener guide beads 74, and an extrusion weld region 84.

Figure 23:
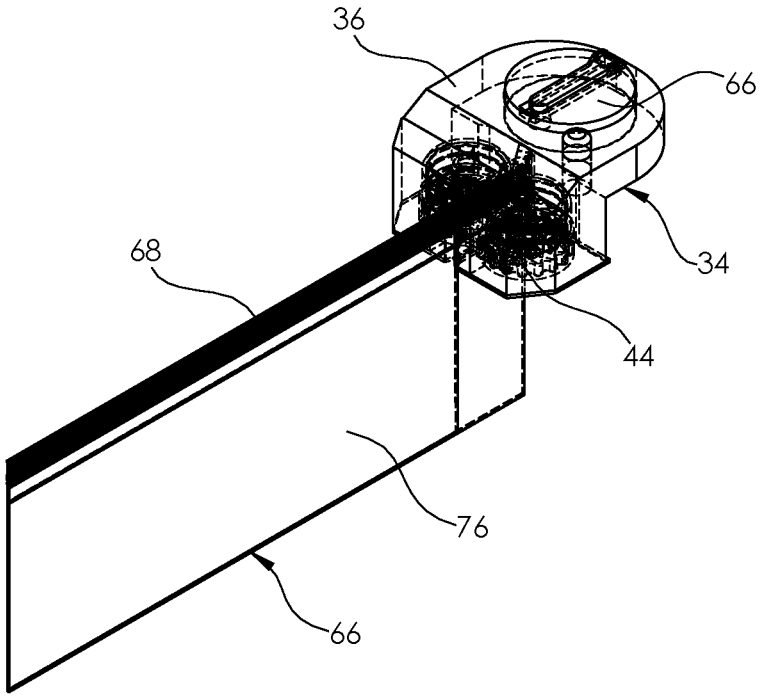
FIG. 23 is a perspective view of a drive assembly with bag installed according to one embodiment of the present invention.

FIG. 23 illustrates, according to one embodiment, drive assembly 34 including upper drive housing 36, crank handle 40, and drive rollers 44, and zipper bag assembly 66 comprising bag film 76 and zipper extrusion 68. A bag of zipper bag assembly 66 is shown installed in drive assembly 34.

Figure 24:
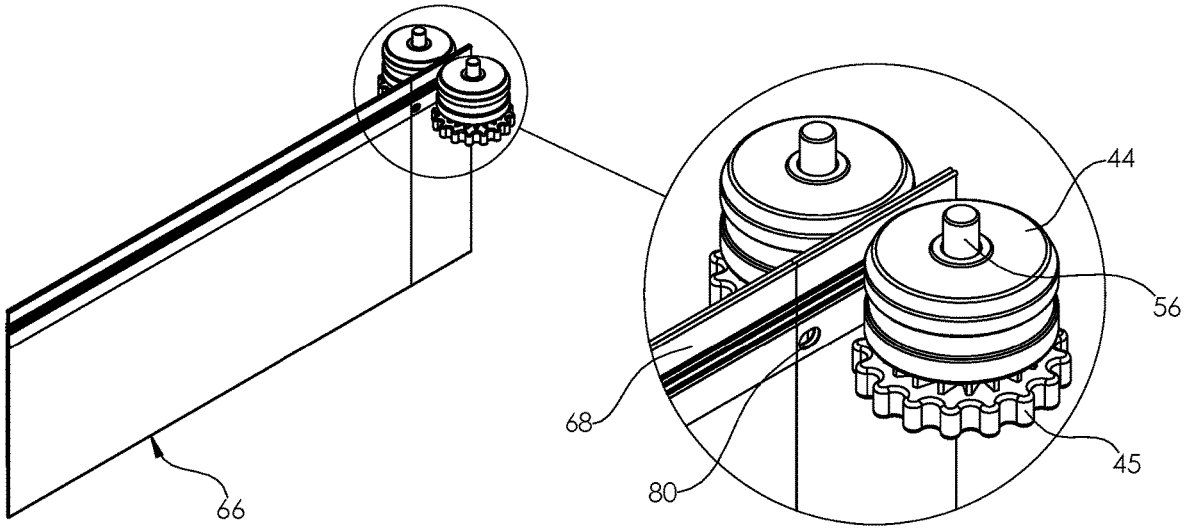
FIG. 24 is a perspective view of a drive rollers with bag installed including a close-up view according to one embodiment of the present invention.

FIG. 24 illustrates, according to one embodiment, a bag of zipper bag assembly 66 which is installed in drive rollers 44 of drive assembly (34). A close-up view includes drive rollers 44, drive lobes 45 and roller shafts 46 of drive assembly (34), and zipper extrusion 68 and indexing hole 80 of zipper bag assembly 66. (The rest of the assembly is hidden.)

Figure 25:
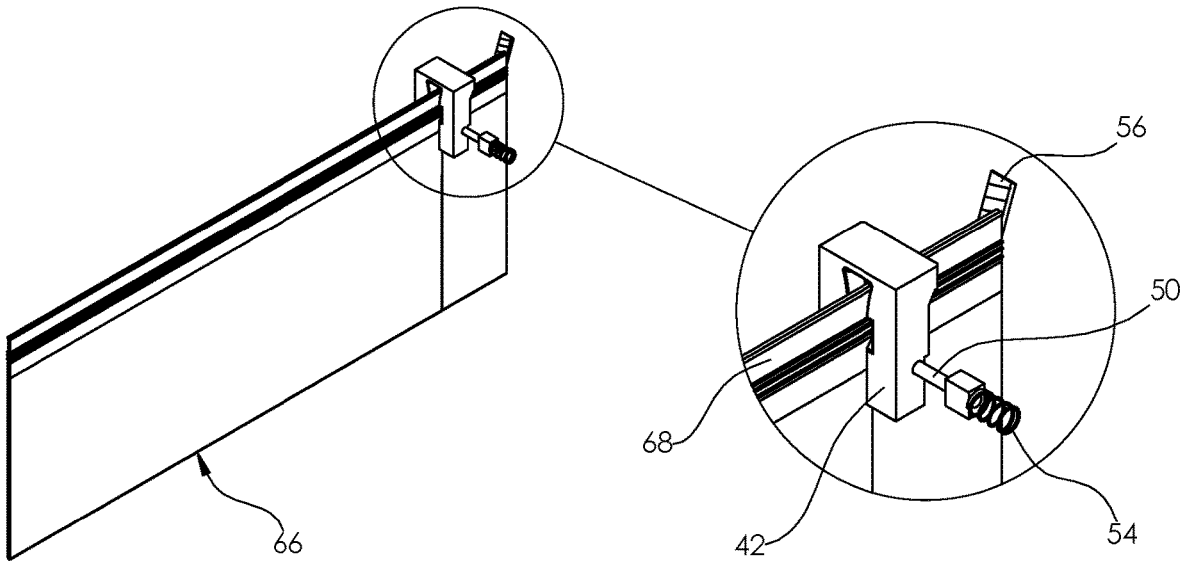
FIG. 25 is a perspective view of a bag closer guide with indexing pin and bag cutter including a close-up view according to one embodiment of the present invention.

FIG. 25 illustrates, according to one embodiment, zipper bag assembly 66 installed in bag closer guide 42, indexing pin 50, and a bag cutter/separator 56. A close-up view shows, in addition to the aforementioned features, indexing spring 54 and zipper extrusion 68. (The rest of the assembly is hidden.)

Figure 26:
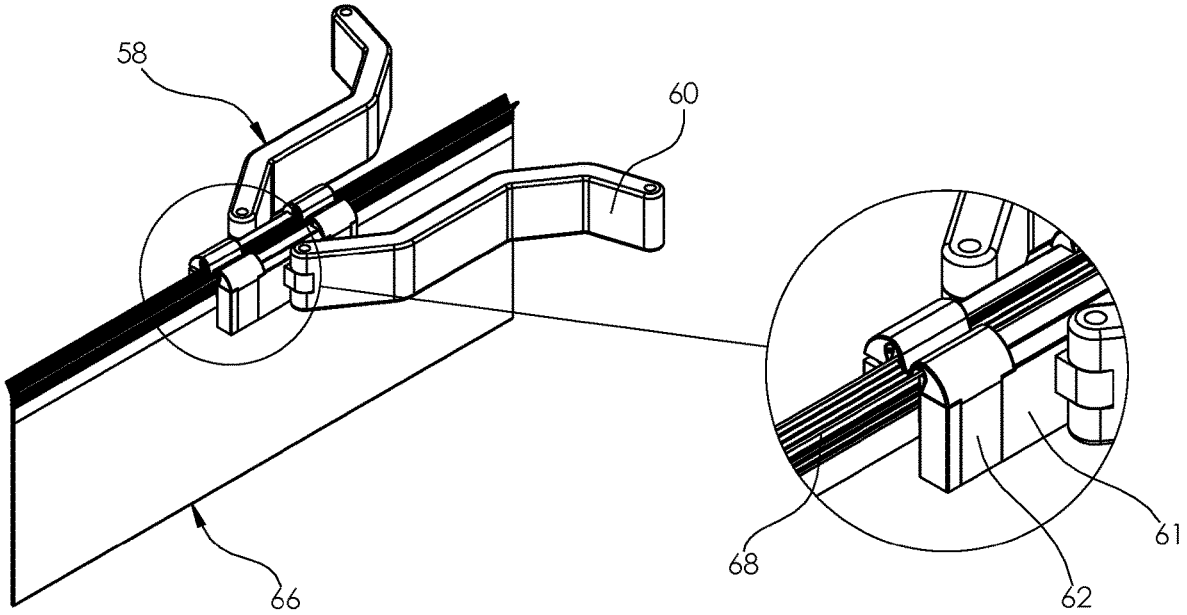
FIG. 26 is a perspective view of the opener arms closed with the bag installed including a close-up view according to one embodiment of the present invention.

FIG. 26 illustrates, according to one embodiment, a closed set of opener arms 60 of opener arm assembly 58, with an installed bag of zipper bag assembly 66. A close-up view shows clip holder 61 and bag clip 62 of opener arm assembly (58), and zipper extrusion 68 of zipper bag assembly (66). (The rest of the assembly is hidden.)

Figure 27:
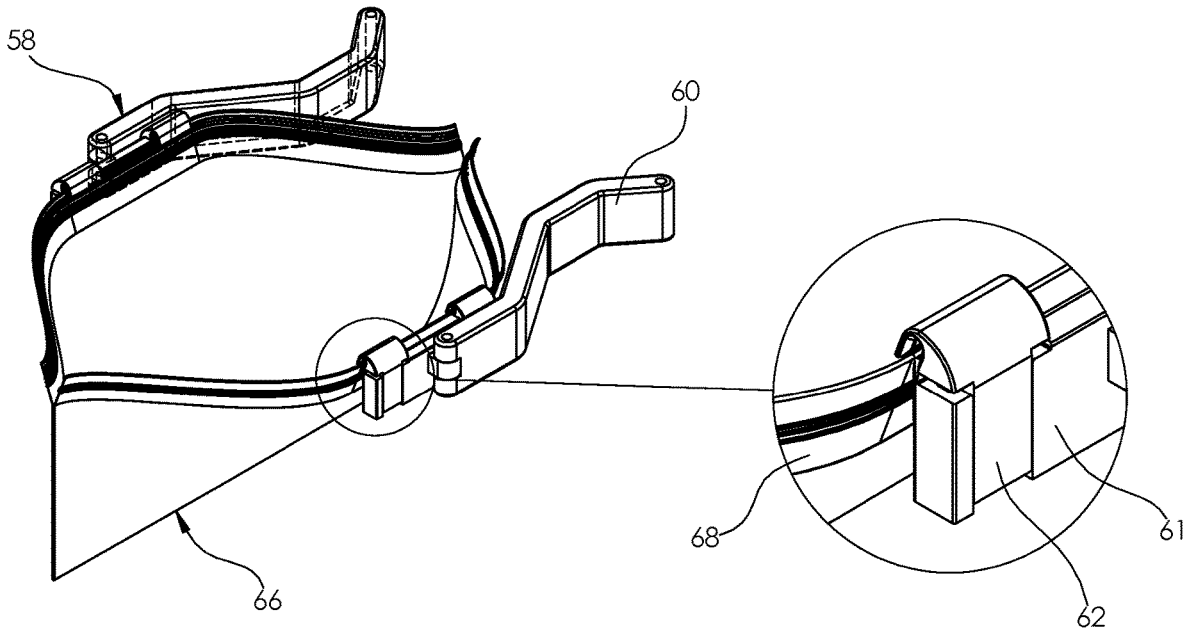
FIG. 27 is a perspective view of the opener arms opened and the bag installed including a close-up view according to one embodiment of the present invention.

FIG. 27 illustrates, according to one embodiment, opener arm assembly 58 in which opener arms 60 are opened, thereby opening the bag of zipper bag assembly 66. A close-up view shows clip holder 61 and bag clip 62, and zipper extrusion 68. (The rest of the assembly is hidden.)

Figure 28:
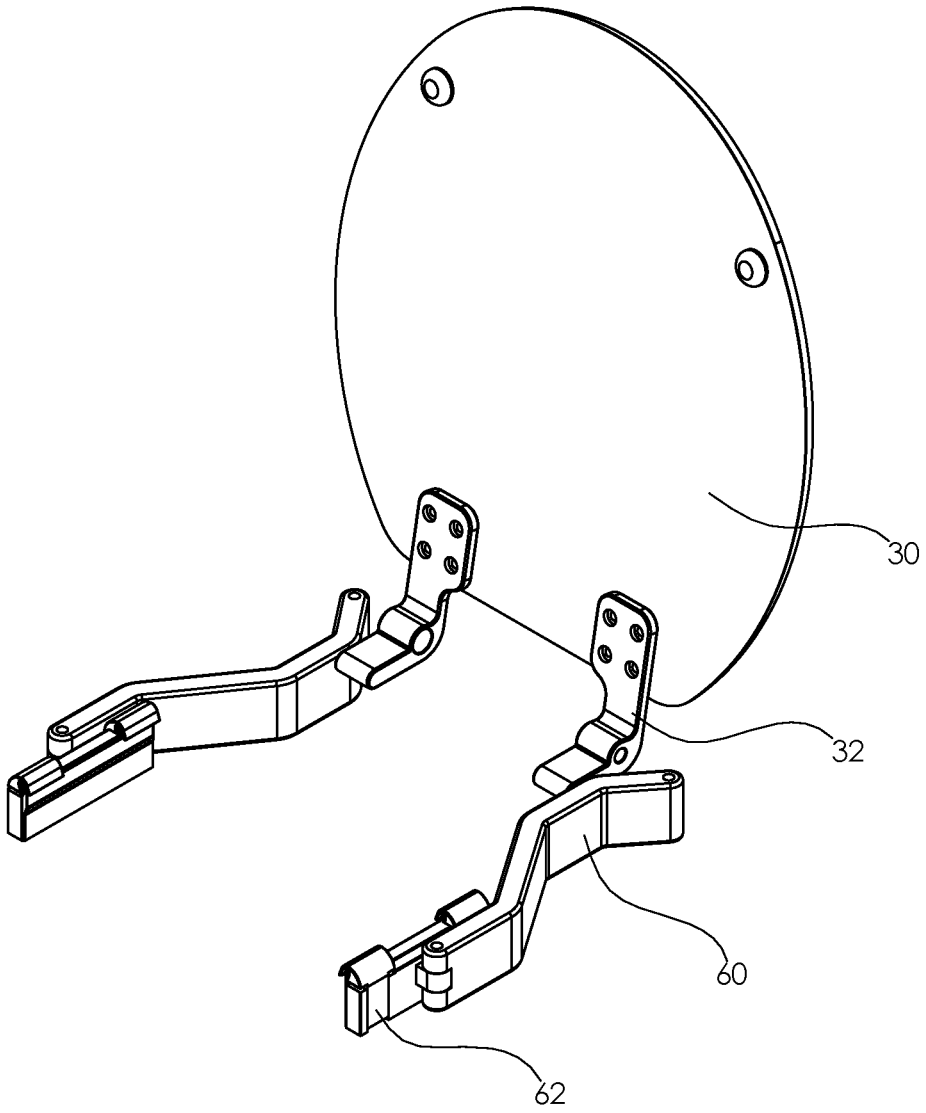
FIG. 28 is a perspective view of a pair of toilet lid hinges engaging a pair of opener arms according to one embodiment of the present invention.

FIG. 28 illustrates, according to one embodiment, toilet lid 30 having a pair of toilet lid hinges 32 engaging a pair of opener arms 60, each having an associated bag clip 62.

Figure 29:
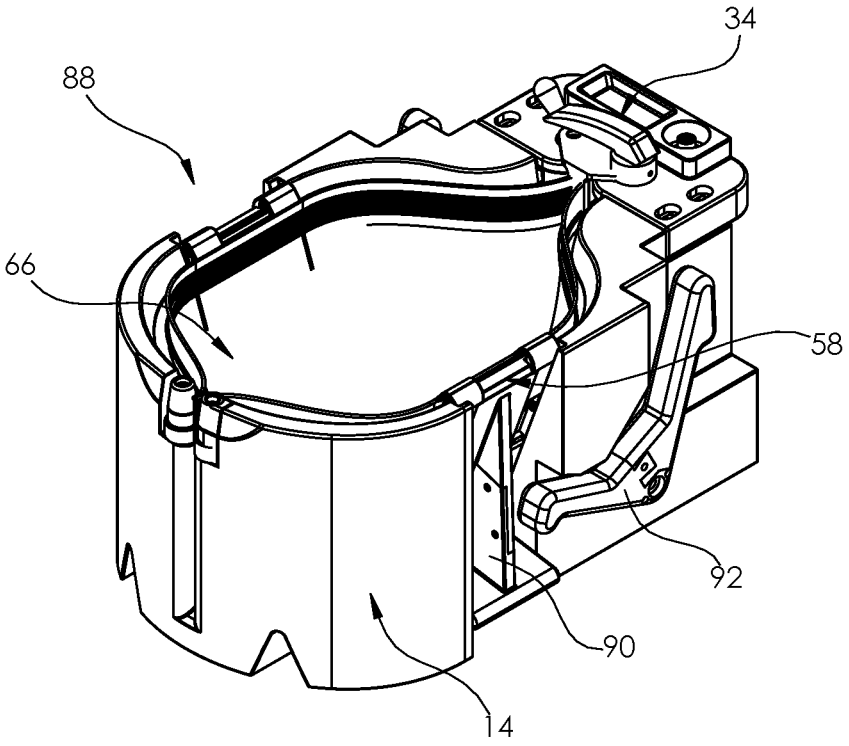
FIG. 29 is a perspective view of an embodiment with vertical opener arms according to one embodiment of the present invention.
Figure 30:
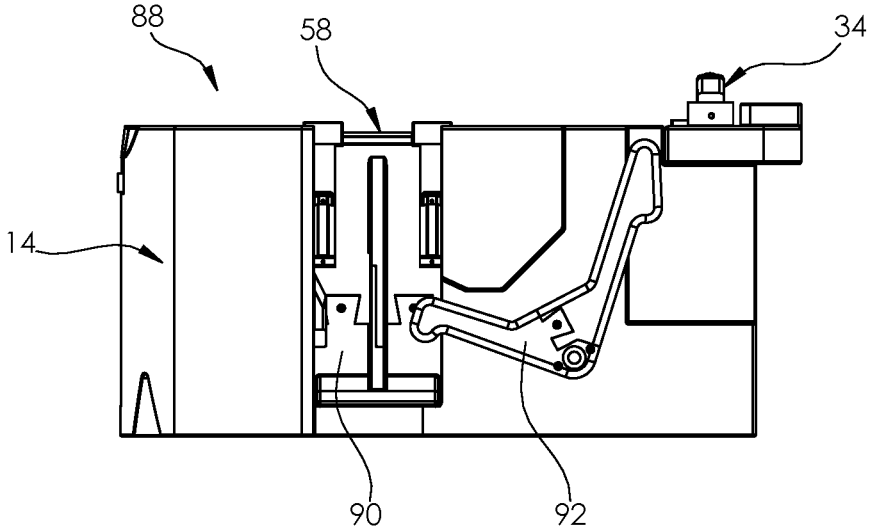
FIG. 30 is a side view of a portable toilet with vertical opener arms according to one embodiment of the present invention.
Figure 31:
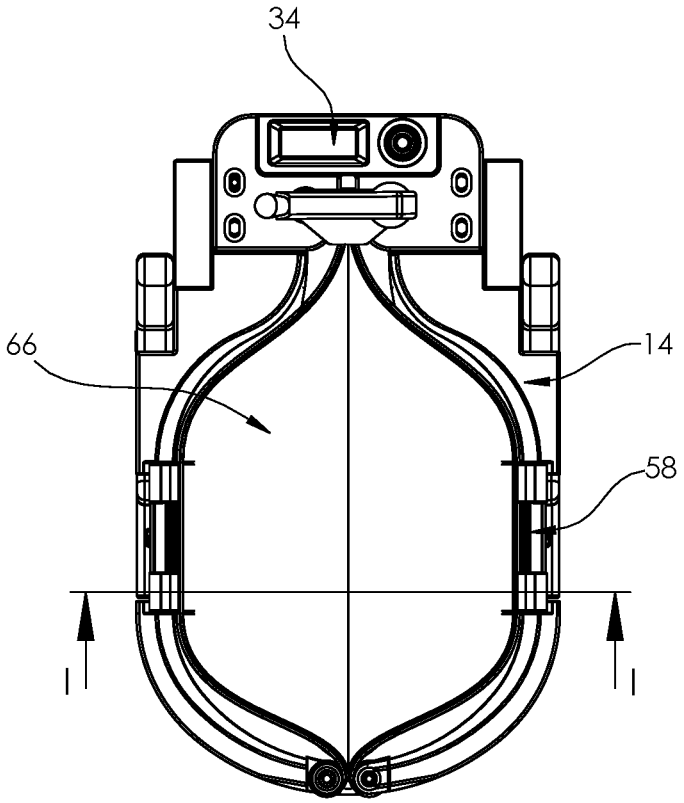
FIG. 31 is a plan view of the portable toilet with vertical opener arms according to one embodiment of the present invention.

FIG. 29, FIG. 30 and FIG. 31 illustrate, according to one embodiment, perspective, side and plan views, respectively, of a portable toilet embodiment with vertical opener arms 88, including main chassis/bowl assembly 14, drive assembly 34, opener arm assembly 58, and zipper bag assembly 66 with an open bag. In FIG. 29 and FIG. 30, opener arm assembly 58 includes (a pair of) vertical opener arms 90 and associated vertical opener linkages 92. In FIG. 29 and FIG. 31, the bag of zipper bag assembly 66 is installed and open.

Figure 32:
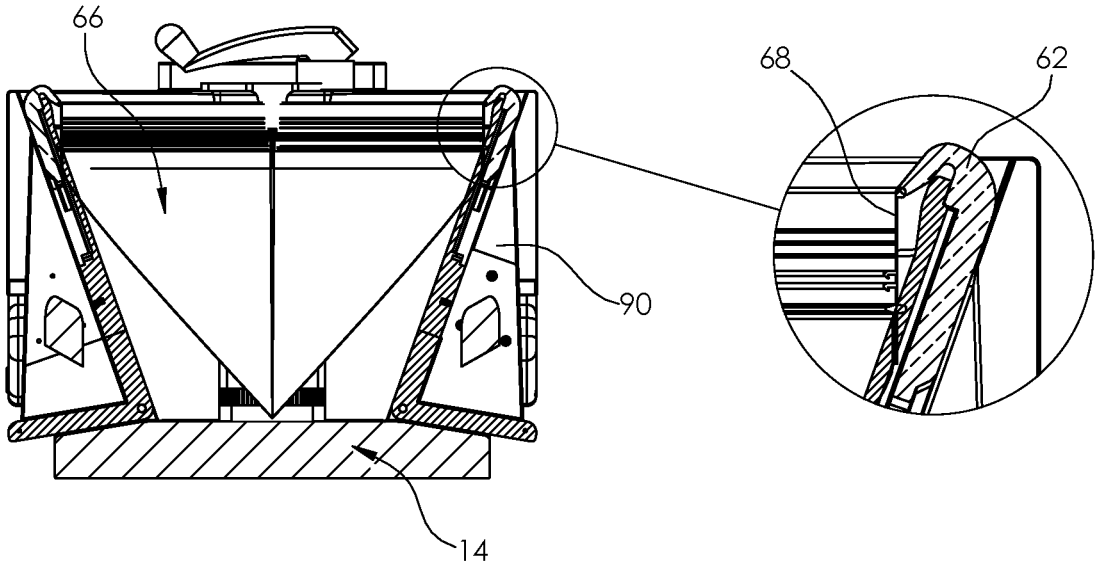
FIG. 32 is cross section along section lines I-I from FIG. 31 of the portable toilet with vertical opener arms including a close-up view according to one embodiment of the present invention.

FIG. 32 illustrate, according to one embodiment, a cross section along section lines I-I from FIG. 31 of portable toilet embodiment with vertical opener arms 88, including a main chassis/bowl 14, zipper bag assembly 66, vertical opener arms 90. A close-up view shows bag clip 62 of the opener arm assembly and zipper extrusion 68 of zipper bag assembly 66.

Figure 33:
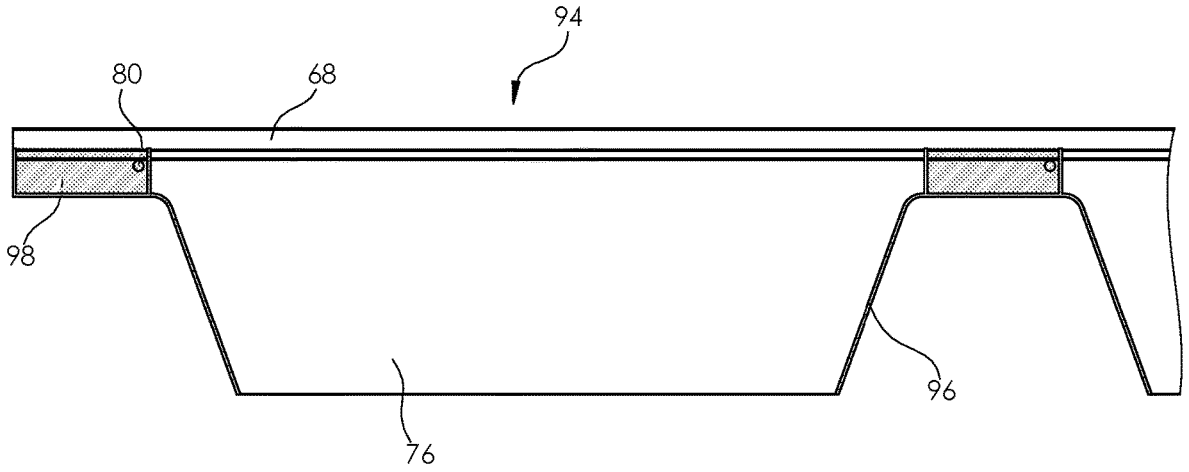
FIG. 33 is a side view of a zipper bag assembly according to one embodiment of the present invention.

FIG. 33 illustrates, according to one embodiment, a zipper bag assembly 94 in which a trapezoidal cut/seal operation (i.e., a chamfered cut-out 96) is applied under each vertical sealed section of the bag (i.e., vertical sealed section/bag cut zone 98). This minimizes the overall bag size and provides a shorter section of bag for the bag cutter to operate on.

Figure 34:
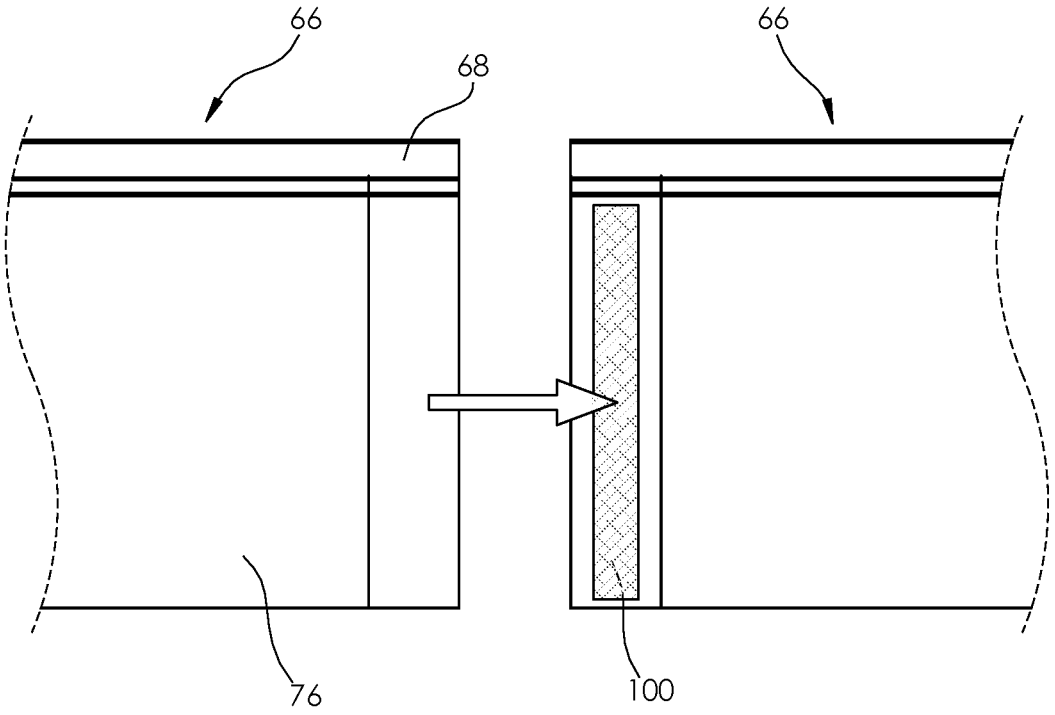
FIG. 34 is a side view of a zipper bag assembly including a bag joiner method according to one embodiment of the present invention.

FIG. 34 illustrates, according to one embodiment, a first zipper bag assembly 66 having a bag connector/adhesive 100 for connecting or joining to a second zipper bag assembly 66 comprising a bag film 76 and zipper extrusion 68.

Figure 35:
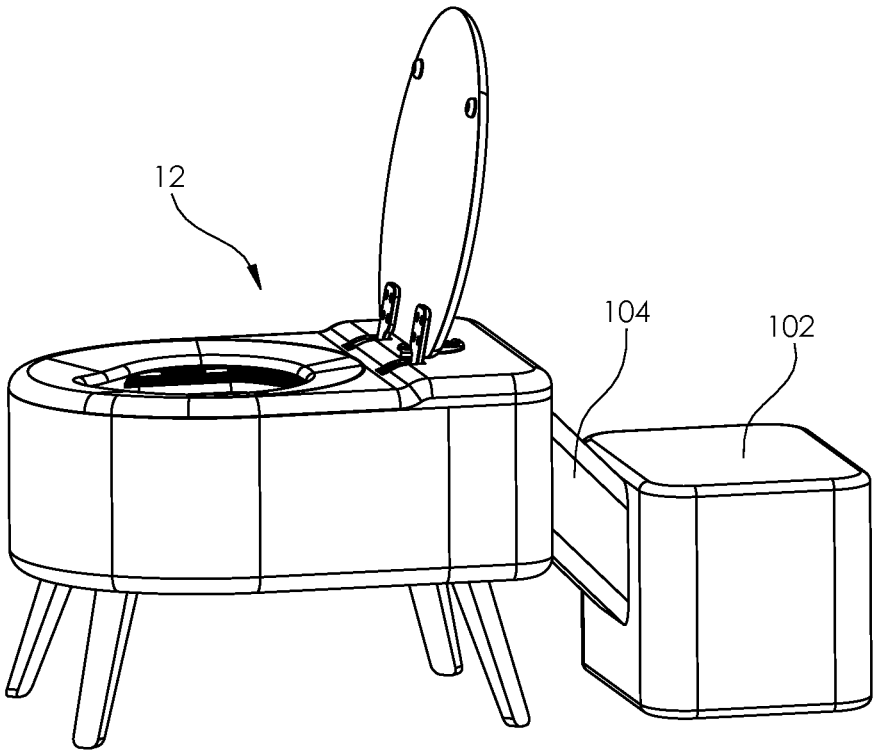
FIG. 35 is a perspective view of the toilet assembly having an external waste compartment according to one embodiment of the present invention.

FIG. 35 illustrates, according to one embodiment, a portable toilet assembly 12, similar to the embodiment shown in FIG. 2, additionally having an external waste compartment 102 and an external waste chute 104 for connecting the toilet assembly 12 to the external waste compartment 102. In another embodiment, external waste chute 104 is substituted with a conveyer, lever or other options suitable to deliver/push the waste bag out of the main chassis or toilet assembly frame/shell to external waste compartment 102 or other suitable location.

In one embodiment, installation of the very first bag refill will involve lifting toilet seat assembly 26 to gain access to the internal bowl assembly (see FIG. 3). The first bag 66 will then be inserted into the guide features at the front (see front bag guide 20 in FIG. 12) and fed into the bag rollers and bag closure guide at the rear (see drive rollers 44 and bag closure guide 42 in FIG. 15). Each half of the zipper can then be clipped (see clip holder 61 and bag clips 62 in FIG. 13) into the bag openers (e.g., opener arms 60) at the center of the bowl (see FIG. 9, FIG. 11 and FIG. 13).

With toilet seat assembly 26 lowered, the toilet lid 30 will be opened ready for use (see FIG. 2 and FIG. 17). In one embodiment, the action of opening toilet lid 30 engages opener arms 60 to retract via a mechanical means, causing the bag to fill main chassis/bowl 16 ready to receive waste (compare FIG. 9 and FIG. 10 [bag closed]; see also FIG. 17 and FIG. 18 [bag open]).

In one embodiment, when the user is finished, they will close toilet lid 30 and activate the flush cycle to pull the used bag through a set of drive rollers 44 and deposit it into waste compartment 24 (see FIG. 9). At the same time a fresh bag will be pulled into its place ready for the next use (see FIG. 10). The flush cycle will have an indexing feature to ensure the user knows when the cycle is complete, and the new bag is correctly in position.

In one embodiment, a set of soft foam rollers or other such compliant means is located below drive rollers 44 to help compress any excess air out of the bags. The user is able to empty waste compartment 24 at their discretion or depending on use case.

In one embodiment, when the first bag refill is finished the user is able to install a new refill without having to access the internal bowl elements. A quick refill access door 18 (see FIG. 5) allows a new bag refill to be attached to the tail of the old bag using a joiner feature (described below).

In one embodiment, the zipper bag refills (i.e., zipper bag assemblies 66) are manufactured from thin flexible plastic film (e.g., bag film 76) to form a continuous horizontal series of bags (see FIG. 20). The top of the bag includes a zipper section (e.g., zipper extrusion 68) to form the closure (see FIG. 20 and FIG. 21).

In one embodiment, the bags are vertically divided into individual bag sections during manufacture (see FIG. 21), with a means of separating the bags between each section for disposal of used bags (e.g., bag cutter/separator 56 in FIG. 16 and bag perforation 78 in FIG. 21). These bags will be sold as a consumable item consisting of a set number of bags (see zipper bag refill cartridge 64 in FIG. 19), to be installed into the toilet by the user.

In one embodiment, the zipper component of the bag is made up of two mating parts, each consisting of a zipper, one upper and one lower set of guide features. In FIG. 22, the upper guide set is in the form of opener guide beads 74, and the lower guide set is in the form of zipper guide ribs 72.

In one embodiment, the lower guide features are used to support the bag in the bag guides and to insert/install into drive rollers 44. The upper guide features are used to guide the bag through opener arms 60. The sealing between bag sections stops at the zipper, with the portion above the zipper un-sealed to allow the upper guide features to be continuous. These features include unique mating features that are required for the toilet to function correctly with the bag.

Frame/Shell Assembly

In one embodiment, the frame/shell assembly is made up of an external frame having one or more compartments for accommodating/housing main chassis/bowl 16 and waste compartment 24.

Frame/Shell

In one embodiment, the frame/shell is a central chassis on which the other sub-assemblies are attached. Depending on the application (as described above) this takes a variety of forms, including the following:

a. Large, fixed frame for permanent installs (i.e., the above described "Fixed" version);
b. Travel frame with fold our legs or such (i.e., the above described "Portable version");
c. Low profile version with car-seat attachments (i.e., the above described "Portable" and "Child" versions);
d. Mounted inside interlocking toolbox or cooler (i.e., the above described "Portable" version");
e. Bedside commode frame (i.e., the above described "Medical Commode" version");
f. Child sized frame (i.e., the above described "Child" version); and
g. Port-a-loo style toilet cubicle (i.e., the above described "Style" version).

Waste Compartment

In one embodiment, waste compartment 24 stores used waste bags and enables the user to easily dispose of them. These come in a variety of sizes depending on the applications described above. In different embodiments the compartment is located in any one of the following locations:

a. In the back of the unit;
b. Under the unit;
c. Beside the unit;
d. Single use for easy disposal or collection; or
e. Remotely using a conveyor or other meaning of transporting bag for larger installs.

In one embodiment, waste container 24 will have a separate entry door.

Depending on the embodiment, the waste compartment is any one of: a secondary bag, a removable box, or any other containing object configured for storage. Waste compartment 24 can be any size, for example:

a. Small capacity of under 5 bags for personal use;
b. Medium capacity of under 25 bags for domestic use; or
c. Large capacity of 100s of uses for a commercial style outdoor toilet used in a sporting or other outdoor event.

The used waste bags can be removed and disposed of after any number of uses, i.e., from one use up to the max capacity of waste compartment 24, depending on the use case and user discretion. Prior to removal/disposal, soiled bags are stored without the user coming into contact with any waste directly. In one embodiment, the bags are separated for disposal by any conventional means, including, but not limited to, any one of the following mechanical means:

a. Mechanically actuated blade after each use (see bag cutter/separator 56 in FIG. 7, FIG. 16 and FIG. 25);
b. Hook knife operated by user upon waste disposal;
c. Bag perforations 78 torn by user upon waste disposal (see FIG. 21);
d. Gravity separating bag along bag perforation 78 after each use (see FIG. 21);
e. Gravity and lever after each use; and
f. Lever only after each use.

Toilet Seat Assembly

In one embodiment, toilet seat assembly 26 comprises toilet seat 28, toilet lid 30, and toilet hinges 32, as detailed in FIG. 6.

Toilet Seat

In one embodiment, the product will utilize any generic, off-the-shelf toilet seat. Other embodiments utilize custom seat profiles, such as, but not limited to:

a. A smaller/narrower opening on a more compact version; and
b. Overall smaller seat and opening for child/portable version.

In another embodiment, toilet seat 28 is configured with an extended rim (or "splash rim") around the internal opening. This will extend vertically down into the main chassis/bowl 16 for splash protection of the bag top and internal mechanisms. In one embodiment, toilet seat 28 is sprung loaded so the flush cycle isn't impeded by the splash rim, i.e., when there is no user sitting on the seat the splash rim is above the bag assembly, but when they sit down it drops the splash rim into the bag opening. Alternatively, the splash rim is engaged via a linkage, cam or other suitable mechanisms known in the art, which is attached to the toilet lid.

Seat material can be existing materials used in toilets, or other hard materials such as metal, or soft materials for comfort like rubber.

Toilet Lid

Different embodiments can utilize either a generic toilet lid or a custom part.

In one embodiment, the product incorporates a mechanism within lid opening operation to actuate bag openers. In one embodiment, a lever-follower mechanism is used, as shown in FIG. 28, wherein toilet hinges 32 engage opener arms 60. Other embodiments include such examples of other mechanical means, including, but not limited to: a pulley system, gears/belts, an electronic motor, or a spring-loaded system, or a combination thereof.

One embodiment, or different embodiments altogether, incorporate any one or more of the following additional mechanisms within the lid opening operation:

a. To engage the splash rim;
b. For bag indexing purposes; and
c. To activate bag change procedure, this can be done via:
   i. Activating switch to engage a motor or spring-loaded gear
   ii. Using lid as a pump
   iii. Using lid as a lever with a gear system to rotate the bag function In one embodiment, toilet lid 30 is configured with a seal incorporated into it for smell proofing.

Toilet Cover

In one embodiment, the toilet lid(30)/seat(28)/hinge(32) assembly is attached to a separately hinged toilet cover. This will enable it to be lifted without engaging the bag opening mechanism described above. The toilet cover is configured to be secured onto the toilet body for travel or transportation though a conventional locking method. Such conventional locking methods include, but is not limited to, seals, rubber locking legs, or any other way to lock lid to the main body.

In one embodiment, the toilet cover is incorporated into, and on the underside of, toilet seat 28 (see FIG. 3, numeral 26, which displays the toilet lid on the underside of toilet seat [28]). In this embodiment, users gain access to the internal bowl, i.e., to the inside of main chassis/bowl assembly 14 by lifting toilet seat 28 (see FIG. 3, numeral 28 omitted) for such purposes as initial bag install, occasional cleaning, maintenance, jams, etc. In another embodiment, the product also includes a quick refill access door 18 for bag replacement without having to lift toilet seat assembly 26 to access zipper bag refill cartridge 64.

Main Chassis/Bowl Assembly

In one embodiment, main chassis/bowl assembly 14 is made up of central main chassis/bowl 16 component, front bag guide 20 (i.e., bag entrance guides), opener arm assembly 58, and storage for new zipper bag refill cartridge 64, as shown in FIG. 3.

Main Chassis/Bowl

In one embodiment, main chassis/bowl 16 is a single central part that zipper bag assembly 66 and drive assembly 34 mount to. In another embodiment, as described above in connection with the frame/shell assembly, the bowl is part of a multi-piece assembly, from which it can be separated and adapted for different arrangements. In one embodiment, main chassis/bowl 16 is configured with conventional/standard mounting features for common attachment to a range of frames/shells. A smaller version is adapted for child use cases. In one embodiment, main chassis/bowl 16 has smooth internal surfaces with minimal crevices for easy cleaning.

Front Bag Guide

In one embodiment, front bag guide 20, which is a bag entrance guide, is configured with a slot for the bag in use (or to be used) to sit into, with shelf feature for associated guide features on bag to be suspended on. In one embodiment, free rollers are provided to reduce friction in the system and help keep the bag retained correctly, and are configured to key into guide features on the bag.

Opener Arm Assembly

In one embodiment, opener arm assembly 58 features vertically pivoting opener arms 60, which fold in and out within main chassis/bowl 16 for bag closing (see FIGS. 9 and 26) and opening (see FIGS. 10 and 27). Opener arms 60 are sprung so that their natural state is in the closed position.

In one embodiment, opener arms 60 are driven via a mechanical linkage to open the bag when toilet lid 30 is opened. This mechanism can be actuated in several different ways, including, but not limited to:

a. By means a linkage as shown in FIG. 28;
b. Using a pulley or chain; or
c. Electrically driven.

In another embodiment, the spring direction will be reversed so the action of drive rollers 44 pulling the bag through achieves the opening and closing of the opener arms as the arms encounter each sealed section in the bag. This removes the need for any linkage mechanism to drive the opener arms.

In one embodiment, opener arms are actuated via another mechanical means, including at least one of, but not limited to:

a. Horizontally pivoting arms;
b. Clips on linear rails;
c. Spring loaded clip underside of seat;
d. Vacuum underneath the device;
e. Full rail that uses positive engagement with bags to make bags travel on correct track and open under seat;
f. Magnetic material in bags and have activated magnets underneath seat in correct position to keep bags open; or
g. Bag can run on fixed or flexible rails around outside of bowl; or
h. A combination thereof.

The aforementioned mechanical means are integrated into the inner bowl of main chassis/bowl 16 to create clean internal surfaces for cleaning.

Bag Clips

In one embodiment, bag clips 62 secure the top bead on the bag (i.e., opener guide beads 74 in FIG. 22) onto bag opener arms 60 and allow the bag to be pulled through them (see FIG. 18; see also FIG. 26 and FIG. 27). Bag clips 62 can be sprung vertically to enable the user to clip the bag in by pulling it upwards into the clips, but to ensure the clips do not release during normal toilet operation, i.e., pulling of roller, opening of bag arms, heavy mass in bag, etc. In one embodiment, opener arm assembly 58 is configured with two bag clips 62 per side to reduce friction. In another embodiment, opener arm assembly 58 is configured with one single long clip (if viable).

In one embodiment, the use of bag clips 62 as described above is substituted with another mechanism, which includes, but is not limited to, any one of: magnets, a sticker-like material, guided holes on a track, or another method of aligning the top of the bag along/through a track, or a combination thereof.

Bag Storage

In one embodiment, main chassis/bowl assembly 14 includes unique features for storing zipper bag refill cartridge 64, including, but not limited to: clips, friction fit, and an interlocking mechanism in the cardboard box that locate into mating features in the main chassis/bowl assembly 14.

In one embodiment, the cartridge comprises a folded bag stored in a box, a rolled bag on a spindle, or individual bags in a box.

Drive Assembly

In one embodiment, drive assembly 34 comprises upper and lower drive housings 36 and 38, drive rollers 44 and drive lobes 45, roller shafts 46, a flush drive mechanism (e.g., crank handle 40), bag closer guide 42, release button 52, gearing between the rollers and drive, bag compressors, indexing mechanism 48 comprising indexing pin 50, release button 52 and indexing spring 54, and bag cutter/separator 56, as detailed in FIG. 7.

Drive Rollers

In one embodiment, drive rollers 44 are configured to drive/pull the bag through during the flush cycle, which results in (1) closing/sealing the zipper section of bag as they roll through and (2) interlocking of drive rollers 44 with guide features on zipper, and suspend bag in place. (See FIGS. 15, 24 and 25.) Drive rollers 44 can be constructed from any material with enough grip to grab the bag.

Flush Drive Mechanism

In one embodiment, drive assembly 34 is activated/engaged when a user actuates the flush drive mechanism. The flush drive mechanism can be located anywhere on the device depending on ergonomics and use case. In one embodiment, the flush drive mechanism is stowed away into a recess in toilet seat assembly 26 (compare FIG. 1 and FIG. 3). In one embodiment the flush drive mechanism is crank handle 40 (see FIG. 7). Crank handle 40 can be integrated to main roller shaft 46 (see FIG. 7 and FIG. 24), or linked via mechanical means, including, but not limited to: meshed gears, belt, or chain.

In one embodiment, the flush drive mechanism (i.e., drive assembly 34) is configured as a one-way drive system to enable a user to rotate the crank handle 40 in reverse without moving the bag in order to allow the handle to be stowed.

In another embodiment the flush drive mechanism utilizes such mechanical configuration, including, but not limited to any one of: lever action, foot pedal, or a combination of an electronic motor with a push button, or a combination thereof.

Drive Gearing

In one embodiment, drive rollers 44 are geared together to ensure no bag slippage occurs.

Bag Compressors

In one embodiment, bag compressors are soft foam discs located on roller spindles that the bag passes through, during which time the bag compressors gently squeeze any surplus air out of the bag without ejecting any waste. In another embodiment, such squeezing out of surplus air, as described, is accomplished by any conventional means, including, but not limited to any one of:

a. Very soft foam cylinder;
b. Compliant flap rollers;
c. Inflated cushion roller; or
d. Soft bristled roller; or
e. A combination thereof.

Indexing Mechanism

In one embodiment, indexing mechanism 48 (see FIG. 25) is configured to act as indication during flush cycle that the bag is in correct position for next use. In one embodiment, this is achieved via a pin latch (e.g., bag closure guide 42, indexing pin 50 and indexing spring 54 in FIG. 7 and FIG. 25) that engages indexing hole 80 located at an end of the bag (see indexing hole 80 in FIG. 21 and FIG. 24), to stop the bag from pulling any further. A further iteration of this embodiment is configured with teeth to lock into a gear on the roller shaft to ensure it doesn't move when the user tries to spin the handle in the drive direction.

In one embodiment, indexing mechanism is configured with a release mechanism for the next flush. Any conventional release mechanism may be used, including, but not limited to:

a. A simple button, such as on a circular saw (see release button 52 in FIG. 1 and FIG. 7);
b. Integrated with handle stowing mechanism, e.g., folding or lifting/dropping of handle; and
c. Integrated with toilet lid opening mechanism.

A further embodiment is configured to provide indexing via visual cues on bag, for example color coding or numbers. Patient numbers can be assigned to bags.

In another embodiment, indexing can be achieved via directly measuring the total number of rotations of the rollers 44. To remove the risk of bag slippage, the bags could have a continuous series of holes, similar to dot matrix printer paper, with which the rollers 44 mesh with.

Zipper bag assemblies 66 are made up of a flexible film with a zipper/closure section along the top (e.g., zipper extrusion 68). In one embodiment, zipper extrusion 68 includes an integrated guide and indexing features.

Manufacture

Zipper bag assembly 66 can be biodegradable or non-biodegradable, colored and opaque or transparent. In one embodiment, zipper extrusion 68 is located along the top of a thin plastic film bag 76 in a continuous length. Bags are provided in in horizontal run with a set number of refills to be sold in refill cartridges 64 to the consumer. In one embodiment, the bags have a pleated fold at the base to help them expand/fill into the main chassis/bowl 16. In one embodiment, each bag has a set length (e.g., 400 mm long) and separated by a sealed section of a given width (e.g., 50 mm), which runs up to the zipper extrusion 68 section only (see FIG. 21). In another embodiment, range of bag lengths is from 250 mm to 600 mm, depending on use case, e.g., from child version to XL version. Sealed section width may be 20 mm to 100 mm, also dependent on end use case. Zipper bag assembly 66 is configured so that each bag can be individually sealed, both water and air-tight. Within the sealed section between bags can be a perforated cut running vertically up the bag (e.g., bag perforation 78 in FIG. 21), for the purpose of separating the bags for disposal following use. In another embodiment, bags are separable via a cutting or tearing mechanism within the toilet, which is activated after each flush.

Zipper/Closure

In one embodiment, zipper/closure is achieved using any conventional system/method, including but not limited to any one of:

a. Interlocking hook version;
b. More traditional bead in channel version;
c. Reversed hooks with squishy seal in center;
d. Contact adhesive, or other adhesive that is activated as it moved through system;
e. Hook and loop strips like Velcro;
f. Magnetic seal; or
g. Heat sealed as it moves through mechanism for closure; or
h. A combination thereof.

Internal vs external bag opening force controlled by thinner sections at bottom vs top:

a. Thinner section at bottom means when the closed bag is compressed the hooks are being pulled perpendicular to each other, and more difficult to open.
b. Thicker section at top means hooks roll outwards from each other to disengage more easily when opened by the toilet mechanism.

Opener Guide Features

In one embodiment, beads having a circular geometry, (e.g., opener guide beads 74 in FIG. 22), or beads having any other geometry such as square, triangle or hexagonal, are located at top of bag for positioning into bag opener arms assembly 58. Sufficient extrusion distance between opener guide beads 74 and zipper to allow clearance for opener arm clips (e.g., bag clips 62 in clip holders 61; see FIG. 8) when they traverse above sealed portion of zipper in between bags.

Roller Guide Features

In one embodiment, external trapezium shaped ribs located below zipper for locating into bag rollers and suspending bag at bowl entrance. On the internal side of these ribs are locating features to roughly guide the bag halves together and ensure they don't slip in the rollers. These are currently a tapered point going into a loose channel.

In another embodiment, the whole zipper section is configured to act as the roller guide feature. In particular, in the embodiment shown in FIG. 22, the guide ribs (72), along with the zipper itself form a solid "rectangle" of sorts that is wider that the features above and below it, allowing this rectangle to be guided into a slot/track.

Zipper Bag Refill Cartridge

In one embodiment, zipper bag refill cartridge 64 is provided in any conventional packaging, including, but not limited to, a cardboard box, a recyclable plastic cartridge, on a roll, or in some other storage means.

Zipper bag refill cartridge 64 is installed into the toilet assembly 12 by the user. Bags can be folded concertina like in package, or rolled. In one embodiment, refill cartridge 64 includes features for installing into toilet cavity of main chassis/bowl 16. The installation features may be of any conventional means, including, but not limited to, any one of the following:

a. Clips on main chassis which mate into corresponding features in bag cartridge;
b. Tabs/flaps on bag cartridge which hook into main chassis;
c. Friction ribs or leaf springs on main chassis; and
d. Barbs which mate into bag cartridge.

Various size configurations of the bag are available, i.e., 5, 25, 100, etc.

Bag Indexing Feature

In one embodiment, an indexing hole 80 is provided below the zipper at the end of each bag of zipper bag assembly 66 (see FIG. 24) for inserting indexing pin 50 pin (see FIG. 25) as described above. The foregoing insertion of indexing pin 50 into indexing hole 80 is useful as a means of knowing when the bag refill is about to run out; for example, double indexing at final bag. In another embodiment this is achieved by color coding on the bag zipper that is visible to the user. This indicates when bag is in correct position (e.g., green), in the middle of flush (e.g., red), or about to run out (e.g., yellow). In a further embodiment, internal numbers are printed on the bag and visible when toilet lid 30 is opened.

Bag Joiner

In one embodiment, the final bag in a first refill cartridge 64 is to be able to be joined to first bag of new/second refill cartridge 64 for ease of replacement by consumer. This could be accomplished in a variety of ways, including, but not limited to:

a. Overlap of zipper features on bags, i.e., each bag has length of half of zipper at ends that mate to each other and interlock through some means;

b. Providing a separate clip part for joining the two bags together; and c. Providing adhesive and/or double-sided tape applied to bags. The adhesive and/or double-sided tape may be applied to the entire height of the bag(s), substantially the entire height of the bag, only along the height of the zipper portion of the bag(s), or only along the height of the bag excluding the zipper portion."

The following is a list of reference numerals and associated parts as used in this specification and drawings:

| Part | Reference numeral |
|---|---|
| "Pack-A-Loo" Portable Toilet Assembly | 12 |
| Main Chassis/Bowl Assembly | 14 |
| Main Chassis/Bowl | 16 |
| Refill Access Door | 18 |
| Front Bag Guide | 20 |
| Fold-Out Legs | 22 |
| Waste Compartment | 24 |
| Toilet Seat Assembly | 26 |
| Toilet Seat | 28 |
| Toilet Lid | 30 |
| Toilet Lid Hinges | 32 |
| Drive Assembly | 34 |
| Upper Drive Housing | 36 |
| Lower Drive Housing | 38 |
| Crank Handle | 40 |
| Bag Closer Guide | 42 |
| Drive Rollers | 44 |
| Drive Lobes | 45 |
| Roller Shafts | 46 |
| Indexing Mechanism | 48 |
| Indexing Pin | 50 |
| Release Button | 52 |
| Indexing Spring | 54 |
| Bag Cutter/Separator | 56 |
| Opener Arm Assembly | 58 |
| Opener Arm | 60 |
| Clip Holder | 61 |
| Bag Clip | 62 |
| Zipper Bag Refill Cartridge | 64 |
| Zipper Bag Assembly | 66 |
| Zipper Extrusion | 68 |
| Zipper Closure | 70 |
| Zipper Guide Ribs | 72 |
| Opener Guide Bead | 74 |
| Bag Film | 76 |
| Bag Perforation | 78 |
| Indexing Hole | 80 |
| Vertical Sealed Section | 82 |
| Extrusion Weld Region | 84 |
| Packaging Cartridge | 86 |
| Portable Toilet Embodiment with Vertical Opener Arms | 88 |
| Vertical Opener Arms | 90 |
| Vertical Opener Linkage | 92 |
| Alternate Embodiment of Zipper Bag Assembly | 94 |
| Chamfered Cutout | 96 |
| Vertical Sealed Section/ Bag Cut Zone | 98 |
| Bag Connector/Adhesive | 100 |
| External Waste Compartment | 102 |
| External Waste Chute | 104 |
| Bag Installed in Front Guide (Cross-Section View) | A-A |
| Bag Installed into Closed Opener Arms (Cross-Section View) | B-B |
| Bag Installed into Closer Guide with Indexing Pin (Cross-Section View) | C-C |
| Bag Installed in Rollers (Cross-Section View) | D-D |
| Bag Cutter (Cross-Section View) | E-E |
| Lid Open, Bag Open (Cross-Section View) | F-F |

-continued

| Part | Reference numeral |
|---|---|
| Zipper Bag Assembly (Cross-Section Detail View) | G-G |
| Embodiment with Vertical Opener Arms (Cross-Section View) | I-I |

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

The invention claimed is:

1. A toilet assembly comprising:

a toilet seat assembly comprising a toilet seat and a toilet lid;

a main chassis;

a front bag guide;

a drive assembly;

an opener arm assembly comprising first and second opener arms configured to pivot between closed and open positions; and a bag assembly comprising at least one waste bag, said waste bag having first and second panels joined to one another along a common bottom edge and along a first side edge and a second side edge so that said waste bag has an interior, said first and second panels having respective top and bottom portions extending between said first side edge and said second side edge, each of said top portions comprising an upper guide bead portion and a lower sealing portion, said upper guide portion forming a top edge defining a mouth opening into said interior, said lower sealing portion comprising an interior-facing sealing mechanism and one or more at least partially exterior-facing guide ribs, said interior-facing mechanism of said first panel oriented to engage said interior-facing mechanism of said second panel to permanently or releasably seal said mouth;

wherein, said drive assembly releasably engages said exterior-facing guide ribs to secure and suspend a first end of said waste bag proximate said first side edge, and said front bag guide releasably engages said exterior-facing guide ribs to secure and suspend a second end of said waste bag proximate said second side edge;

wherein, said first opener arm configured to releasably engage said first panel and said second opener arm configured to releasably engage said second panel, whereby when said first and second opener arms pivot to said open position, said first and second panels pivot laterally to said open position, and when said first and second opener arms retract to said closed position, said first and second panels pivot medially to said closed position, whereby said waste bag is closed prior to disposal; and wherein, said drive assembly causes said interior-facing mechanism to seal said waste bag and deposits said sealed waste bag into a waste compartment.

2. The toilet assembly of claim 1, wherein said toilet seat assembly further comprises a pair of actuating members coupled to said toilet lid, said actuating members operatively associated with said first and second opener arms;

wherein, when said toilet lid is opened, said actuating members engage said first and second opener arms, whereby said first and second opener arms pivot to said open position, and when said toilet lid is closed, said actuating members disengage said first and second opener arms, whereby said first and second opener arms retract to said closed position; and wherein said actuating members comprise at least one of a lever-follower mechanism, a pulley mechanism, a gears and belts mechanism, an electronic motor mechanism, or a spring-loaded mechanism, or a combination thereof.

3. The toilet assembly of claim 1, further comprising at least one actuating member causing said first and second opener arms to pivot to said open position and to retract to said closed position, said actuating member comprising at least one of a pair of horizontally pivoting arms, one or more pairs of clips on linear rails, a spring-loaded mechanism on the underside of said toilet seat, a vacuum mechanism arranged beneath said waste bag, a full-rail mechanism using positive engagement with said waste bag, or magnetic material integrated into said waste bag and one or more magnets operatively associated with said magnetic material and arranged beneath said toilet seat, or a combination thereof.

4. The toilet assembly of claim 1, wherein said drive assembly comprises a flush drive mechanism and at least two drive rollers;

wherein said flush drive mechanism comprises at least one of a crank handle, a lever mechanism, a foot pedal, or an electronic motor with a push button, or a combination thereof; and wherein, when said flush drive mechanism is engaged, said closed waste bag is driven through said drive rollers along said exterior-facing guide ribs causing said interior-facing mechanism to seal said waste bag and depositing said sealed waste bag into said waste compartment.

5. The toilet assembly of claim 4, wherein said drive assembly further comprises at least two roller shafts and at least two drive lobes, each operatively associated with a respective one of said drive rollers; and wherein said flush drive mechanism is integrated with said roller shafts.

6. The toilet assembly of claim 4, wherein said drive assembly further comprises at least two roller shafts and at least two drive lobes, each operatively associated with a respective one of said drive rollers; and wherein said flush drive mechanism is mechanically linked to said roller shafts by at least one of a meshed gear, a belt, or a chain, or a combination thereof.

7. The toilet assembly of claim 4, wherein said drive assembly further comprises a bag compressor mechanism, said bag compressor mechanism comprising at least one of soft foam cylinders, compliant flap rollers, inflated cushion rollers, or soft bristled rollers, or a combination thereof.

8. The toilet assembly of claim 4, wherein said drive assembly further comprises a pin latch mechanism configured to engage an indexing hole of said waste bag.

9. The toilet assembly of claim 1, wherein said toilet assembly further comprises a splash rim extending vertically down into said main chassis within said mouth of said waste bag, said splash rim actuated downwards by at least one of a spring-loaded mechanism, a linkage, or a cam, or a combination thereof.

10. The toilet assembly of claim 1, wherein said opener arm assembly further comprises at least one bag clip and clip holder coupled to said first opener arm and configured to secure said upper guide bead portion of said first panel to said first opener arm, and at least one bag clip and clip holder coupled to said second opener arm and configured to secure said upper guide bead portion of said second panel to said second opener arm.

11. The toilet assembly of claim 1, wherein said opener arm assembly further comprises at least one of magnets, adhesive or semi-adhesive material, or a mechanism having guided holes on a track, or a combination thereof, to secure said upper guide bead portions of said first and second panels to said first and second opener arms.

12. The toilet assembly of claim 1, further comprising a bag refill compartment for storing a bag refill cartridge and a refill access door for accessing said bag refill compartment.

13. The toilet assembly of claim 1, wherein said interior-facing mechanism comprises at least one of a zipper closure, an interlocking hook mechanism, a bead-in-channel setting, a reversed hooks with malleable seal in center, a contact adhesive, hook-and-loop strips, a magnetic seal, or a heat-sealing mechanism, or a combination thereof.

14. The toilet assembly of claim 1, further comprising a bag joiner interlocking mechanism for coupling said second end of a last waste bag in a first bag refill cartridge to said first end of a first waste bag in a second bag refill cartridge.

15. The toilet assembly of claim 1, wherein said bag assembly is disposed within said main chassis assembly.

16. The toilet assembly of claim 1, wherein said waste compartment is an external waste compartment; and wherein said toilet assembly further comprises a chute directing said waste bag into said external waste compartment.

17. A toilet assembly comprising:

a toilet seat assembly comprising a toilet seat and a toilet lid;

a main chassis;

a front bag guide;

a drive assembly;

an opener arm assembly comprising first and second opener arms configured to pivot between closed and open positions; and a bag assembly comprising at least one waste bag, said waste bag having a first outer side edge, an inner side edge, and a second outer side edge, said waste bag having a first vertical section formed between said first outer side edge and said inner side edge, said waste bag having a second vertical section formed between said inner side edge and said second outer side edge, said first and second vertical sections joined to one another along said inner side edge, said first vertical section comprising a sealed section, a first upper guide bead portion, and one or more at least partially exterior-facing first guide ribs, said second vertical section comprising first and second panels joined to one another along a common bottom edge and along said second outer side edge and said inner side edge so that said waste bag has an interior, said first and second panels having respective top and bottom portions extending between said second outer side edge and said an inner side edge, each of said top portions comprising a second upper guide bead portion and a lower sealing portion, said second upper guide portion forming a top edge defining a mouth opening into said interior, said lower sealing portion comprising an interior-facing sealing mechanism and one or more at least partially exterior-facing second guide ribs, said interior-facing mechanism of said first panel oriented to engage said interior-facing mechanism of said second panel to permanently or releasably seal said mouth;

wherein, said drive assembly releasably engages said exterior-facing first guide ribs of said first vertical section to secure and suspend a first end of said waste bag proximate to said first outer side edge, and said front bag guide releasably engages said exterior-facing second guide ribs of said second vertical section to secure and suspend a second end of said waste bag proximate to said second outer side edge;

wherein, said first opener arm configured to releasably engage said first panel and said second opener arm configured to releasably engage said second panel, whereby when said first and second opener arms pivot to said open position, said first and second panels pivot laterally to said open position, and when said first and second opener arms retract to said closed position, said first and second panels pivot medially to said closed position, whereby said waste bag is closed prior to disposal; and wherein, said drive assembly causes said interior-facing mechanism to seal said second vertical section of said waste bag and deposits said sealed waste bag into a waste compartment.

18. The toilet assembly of claim 17, wherein said drive assembly comprises a flush drive mechanism, at least two drive rollers and a pin latch mechanism, said pin latch mechanism configured to engage an indexing hole of said first section of said waste bag; and wherein, when said flush drive mechanism is engaged, said closed waste bag is driven through said drive rollers along said first and second exterior-facing guide ribs causing said interior-facing mechanism to seal said second vertical section of said waste bag and depositing said sealed waste bag into said waste compartment.

19. The toilet assembly of claim 18, wherein said waste compartment is an external waste compartment; and wherein said toilet assembly further comprises a chute directing said waste bag into said external waste compartment.

20. The toilet assembly of claim 17, wherein said waste compartment is an external waste compartment; and wherein said toilet assembly further comprises a chute directing said waste bag into said external waste compartment.

* * * * *